US008272410B2

(12) United States Patent
Elgan et al.

(10) Patent No.: US 8,272,410 B2
(45) **Date of Patent: *Sep. 25, 2012**

(54) FLUID BIN ASSEMBLY WITH HOIST

(75) Inventors: Gregory P. Elgan, Providence, UT (US); Brett L. Allred, Hyde Park, UT (US); Gary Graetz, Smithfield, UT (US); Jeremy K. Larsen, Providence, UT (US); Jim A. Austin, Forth Worth, TX (US)

(73) Assignee: HyClone Laboratories, Inc., Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/183,060

(22) Filed: Jul. 14, 2011

(65) Prior Publication Data

US 2011/0271646 A1 Nov. 10, 2011

Related U.S. Application Data

(60) Continuation of application No. 12/559,359, filed on Sep. 14, 2009, now Pat. No. 7,992,598, which is a division of application No. 11/865,504, filed on Oct. 1, 2007, now Pat. No. 7,588,161, which is a division of application No. 10/810,156, filed on Mar. 26, 2004, now Pat. No. 7,284,579.

(60) Provisional application No. 60/458,895, filed on Mar. 28, 2003.

(51) Int. Cl.
*B65B 1/04* (2006.01)

(52) U.S. Cl. ..... 141/10; 141/114; 141/314; 141/316

(58) Field of Classification Search ..... 141/2, 10, 141/114, 314–416; 248/99–101; 53/381.1, 53/384.1, 492, 570
See application file for complete search history.

(56) References Cited

U.S. PATENT DOCUMENTS

| | | | |
|---|---|---|---|
| 301,753 | A | 7/1884 | Porter et al. |
| 508,408 | A | 11/1893 | Cogswell |
| 797,215 | A | 8/1905 | Osborne et al. |
| 901,034 | A | 10/1908 | Patterson |
| 935,076 | A | 9/1909 | Wemhoff |
| 1,118,738 | A | 11/1914 | Carroll |

(Continued)

FOREIGN PATENT DOCUMENTS

DE 4039836 A1 6/1992

(Continued)

OTHER PUBLICATIONS

The *Flexel 3-D System*, Stedim, Inc., 1998.

(Continued)

*Primary Examiner* — Timothy L Maust
(74) *Attorney, Agent, or Firm* — Workman Nycegger

(57) ABSTRACT

A method for filling a dispensing bag includes inserting a collapsed bag within a chamber of a bin and securing a lower end of the collapsed bag to the bin. After securing the lower end of the collapsed bag to the bin, a hoist coupled to an upper end of the collapsed bag is manipulated so that the hoist raises the upper end of the collapsed bag within the chamber while the lower end of the collapsed bag remains secured to the bin so as to expand the collapsed bag within the chamber of the bin.

28 Claims, 24 Drawing Sheets

U.S. PATENT DOCUMENTS

| | | | | | |
|---|---|---|---|---|---|
| 1,272,222 | A | | 7/1918 | Clayton | |
| 1,976,014 | A | | 10/1934 | Forsythe | |
| 2,315,365 | A | | 3/1943 | Christy | |
| 2,579,685 | A | | 12/1951 | Loose | |
| 2,649,991 | A | | 8/1953 | Woock | |
| 2,720,998 | A | | 10/1955 | Potter | |
| 2,805,793 | A | | 9/1957 | Crisafulli | |
| 2,826,329 | A | | 3/1958 | Beckner | |
| 2,894,666 | A | | 7/1959 | Campbell, Jr. | |
| 2,916,161 | A | | 12/1959 | Schaefer | |
| 2,973,119 | A | | 2/1961 | Parker | |
| 3,105,617 | A | | 10/1963 | Fredrik | |
| 3,212,681 | A | | 10/1965 | Weikert | |
| 3,343,719 | A | | 9/1967 | Kastamo et al. | |
| 3,403,826 | A | * | 10/1968 | Buford et al. | 222/334 |
| 3,481,511 | A | | 12/1969 | Metke | |
| 3,735,898 | A | | 5/1973 | Smith | |
| 3,874,569 | A | | 4/1975 | Fossett et al. | |
| 3,908,864 | A | | 9/1975 | Capper | |
| 3,960,294 | A | | 6/1976 | Bernard | |
| 4,119,263 | A | | 10/1978 | Cuthbertson et al. | |
| 4,271,987 | A | | 6/1981 | Eriksson et al. | |
| 4,390,051 | A | | 6/1983 | Cuthbertson | |
| 4,420,021 | A | * | 12/1983 | Strand et al. | 141/10 |
| 4,421,253 | A | | 12/1983 | Croley | |
| 4,452,030 | A | * | 6/1984 | Inada | 53/426 |
| 4,591,065 | A | | 5/1986 | Foy | |
| 4,666,064 | A | | 5/1987 | Hoehn | |
| 4,688,979 | A | | 8/1987 | Kupersmit | |
| 4,718,464 | A | | 1/1988 | Delves et al. | |
| 4,817,824 | A | | 4/1989 | LaFleur et al. | |
| 4,883,201 | A | | 11/1989 | Poulton | |
| 4,953,754 | A | | 9/1990 | Credle, Jr. | |
| 4,998,991 | A | | 3/1991 | Poulton | |
| 5,000,352 | A | | 3/1991 | Cleland | |
| 5,033,649 | A | | 7/1991 | Copeland et al. | |
| 5,050,775 | A | * | 9/1991 | Marquardt | 222/93 |
| 5,269,579 | A | | 12/1993 | DeCrane | |
| 5,333,757 | A | | 8/1994 | Volk et al. | |
| 5,333,777 | A | | 8/1994 | Roth | |
| 5,348,063 | A | | 9/1994 | Handleman | |
| 5,383,576 | A | | 1/1995 | Richter et al. | |
| 5,402,915 | A | | 4/1995 | Hogan | |
| 5,531,352 | A | | 7/1996 | Kraft et al. | |
| 5,535,791 | A | | 7/1996 | Lisec | |
| 5,549,707 | A | | 8/1996 | Weaver | |
| 5,584,327 | A | | 12/1996 | Thomas et al. | |
| 5,673,817 | A | | 10/1997 | Mullen et al. | |
| 5,810,204 | A | | 9/1998 | Devlin et al. | |
| 5,873,498 | A | | 2/1999 | Moore et al. | |
| 5,897,012 | A | | 4/1999 | Sortwell | |
| 5,944,227 | A | | 8/1999 | Schroeder et al. | |
| 5,944,455 | A | | 8/1999 | Wilhelm | |
| 5,947,334 | A | | 9/1999 | Rudick et al. | |
| 5,975,155 | A | * | 11/1999 | Sienerth et al. | 141/84 |
| 5,988,422 | A | | 11/1999 | Vallot | |
| 6,076,457 | A | | 6/2000 | Vallot | |
| 6,186,932 | B1 | | 2/2001 | Vallot | |
| 6,202,708 | B1 | | 3/2001 | Bynum | |
| 6,223,903 | B1 | * | 5/2001 | Mansouri | 206/600 |
| 6,253,806 | B1 | | 7/2001 | Sperry et al. | |
| 6,286,700 | B1 | | 9/2001 | Davidson | |
| 6,293,318 | B1 | | 9/2001 | Schmidt et al. | |
| 6,302,299 | B1 | | 10/2001 | Baker et al. | |
| 6,345,734 | B2 | | 2/2002 | Schalow et al. | |
| 6,427,955 | B1 | | 8/2002 | Sterner et al. | |
| 6,543,495 | B2 | | 4/2003 | Hougland | |
| 6,634,783 | B2 | | 10/2003 | Baron | |
| 6,659,132 | B2 | | 12/2003 | Smith et al. | |
| 6,929,155 | B1 | | 8/2005 | Sayers | |
| 7,284,579 | B2 | | 10/2007 | Elgan et al. | |
| 7,992,598 | B2 | * | 8/2011 | Elgan et al. | 141/10 |
| 2003/0029982 | A1 | | 2/2003 | Hurst et al. | |
| 2003/0075663 | A1 | | 4/2003 | Hurst et al. | |
| 2004/0027912 | A1 | | 2/2004 | Bibbo et al. | |
| 2004/0074922 | A1 | | 4/2004 | Bothor et al. | |
| 2004/0149766 | A1 | | 8/2004 | Karpisek | |
| 2005/0045639 | A1 | | 3/2005 | Thorpe | |
| 2007/0064519 | A1 | | 3/2007 | Neumann | |
| 2008/0017649 | A1 | | 1/2008 | Elgan et al. | |
| 2009/0114311 | A1 | | 5/2009 | McDowell | |

FOREIGN PATENT DOCUMENTS

| | | | |
|---|---|---|---|
| EP | 0072783 | A1 | 2/1983 |
| EP | 0586994 | A1 | 3/1994 |
| GB | 2069461 | A | 8/1981 |
| GB | 2078676 | A | 1/1982 |
| WO | WO 93/17930 | A1 | 9/1993 |

OTHER PUBLICATIONS

Office Action dated Aug. 17, 2006 issued to U.S. Appl. No. 10/810,156.

Office Action dated Dec. 8, 2006 issued to U.S. Appl. No. 10/810,156.

Office Action dated May 11, 2007 issued to U.S. Appl. No. 10/810,156.

Office Action dated Sep. 26, 2008 issued to U.S. Appl. No. 11/865,504.

Notice of allowance dated May 11, 2009 issued to U.S. Appl. No. 11/865,504.

Office Action dated Nov. 8, 2010 issued to U.S. Appl. No. 12/559,359.

Notice of allowance dated Mar. 21, 2011 issued to U.S. Appl. No. 12/559,359.

* cited by examiner

FLUID BIN ASSEMBLY WITH HOIST

CROSS-REFERENCE TO RELATED APPLICATIONS

This application is a continuation of U.S. application Ser. No. 12/559,359, filed Sep. 14, 2009, which is a divisional of U.S. application Ser. No. 11/865,504, filed Oct. 1, 2007, now U.S. Pat. No. 7,588,161, which is a divisional of application Ser. No. 10/810,156, filed Mar. 26, 2004, now U.S. Pat. No. 7,284,579 and claims priority to Provisional Application Ser. No. 60/458,895, filed Mar. 28, 2003, the entirety of which are incorporated herein by specific reference.

BACKGROUND OF THE INVENTION

1. The Field of the Invention

The present invention relates to bins for use in storing, moving, processing and/or dispensing fluids.

2. The Relevant Technology

The biopharmaceutical industry uses large quantities of different types of fluids in their research, testing, and production of final product. Examples of such fluids include media, buffers, and reagents. Critical to the biopharmaceutical industry is the ability to easily transport, process, and dispense such fluids while preventing unwanted contamination. Historically such fluids have been held in stainless steel containers which required cleaning and sterilization between uses. To avoid the burden of repeated tank cleaning, current approaches to the storage and dispending of fluids have utilized fluid dispensing bins.

Conventional fluid dispensing bins comprise an open top bin having a fixed floor with a fixed porthole extending therethrough. A disposable bag having a fluid line extending therefrom is disposed within the bin so that the fluid line extends out of the porthole. The disposable bag can be presterilized so as to prevent contamination of fluids that pass therethrough. Once the bag is filled with fluid, the bag provides a ready supply of the fluid for desired processing. Once the bag is empty, the bag can be replaced with a new bag without cleaning.

Although conventional fluid dispensing bins are useful, they have a number of shortcomings. For example, conventional fluid dispensing bins have a fixed floor with a fixed porthole configuration so that the customer is required to purchase from the bin manufacturer the corresponding bag that is designed to fit the bin. As a result, customers are limited in their ability to purchase bags from other producers in that the bags may not fit properly within the bin. Furthermore, due to the fixed nature of the bins, customers are unable to request customized bag designs that may be more useful under different processing or dispensing conditions. In addition, bags are often preassembled and then sterilized with other structures such as filters. However, once a filter or other structure is secured to the fluid line extending from a bag, the bag can no longer be used with the bin in that the filter cannot be passed through the fixed port hole on the floor of the bin.

Accordingly, what is needed in the art are fluid dispensing bins that can be easily used with a broad range of bag designs and bag assemblies.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
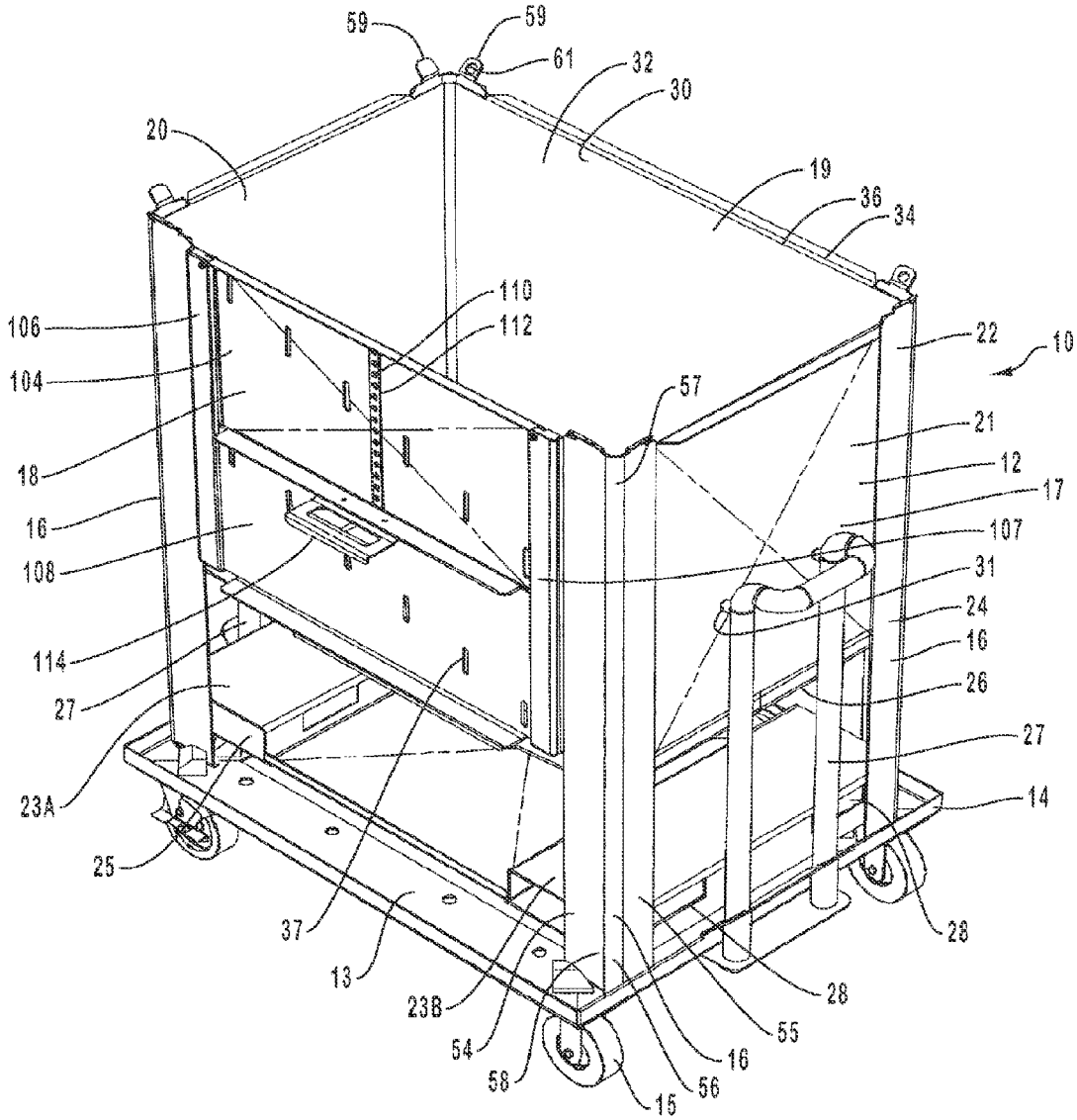
FIG. 1 is a perspective view of one embodiment of a fluid bin assembly mounted on a dolly.

Depicted in FIG. 1 is a perspective view of one embodiment of a fluid bin assembly 10 incorporating features of the present invention. In general, fluid bin assembly 10 includes a hollow rectangular bin 12 supported by vertical corner legs 16. As will be discussed below in greater detail, bin assembly 10 is used in the storage, movement, processing and/or dispensing of fluids.

In the embodiment depicted in FIG. 1, bin assembly 10 is removably positioned on a dolly 14 which enables easy movement of bin assembly 10, and thus the fluid therein, between different locations. Dolly 14 is an optional accessory and comprises a frame 13 having wheels 15 mounted thereon. A substantially U-shaped handle 27 upwardly projects from each end of frame 13 to facilitate maneuverability of dolly 14. A pair of bumpers 31 project from each handle 27. Bumpers 31 bias against the sides of bin 12 so as to support handles 27. Dolly 14 can form a portion of the bin assembly or can be eliminated. That is, bin 12 can be selectively lifted from dolly 14 so that legs 16 rest directly on a ground surface or other structure.

Figure 2:
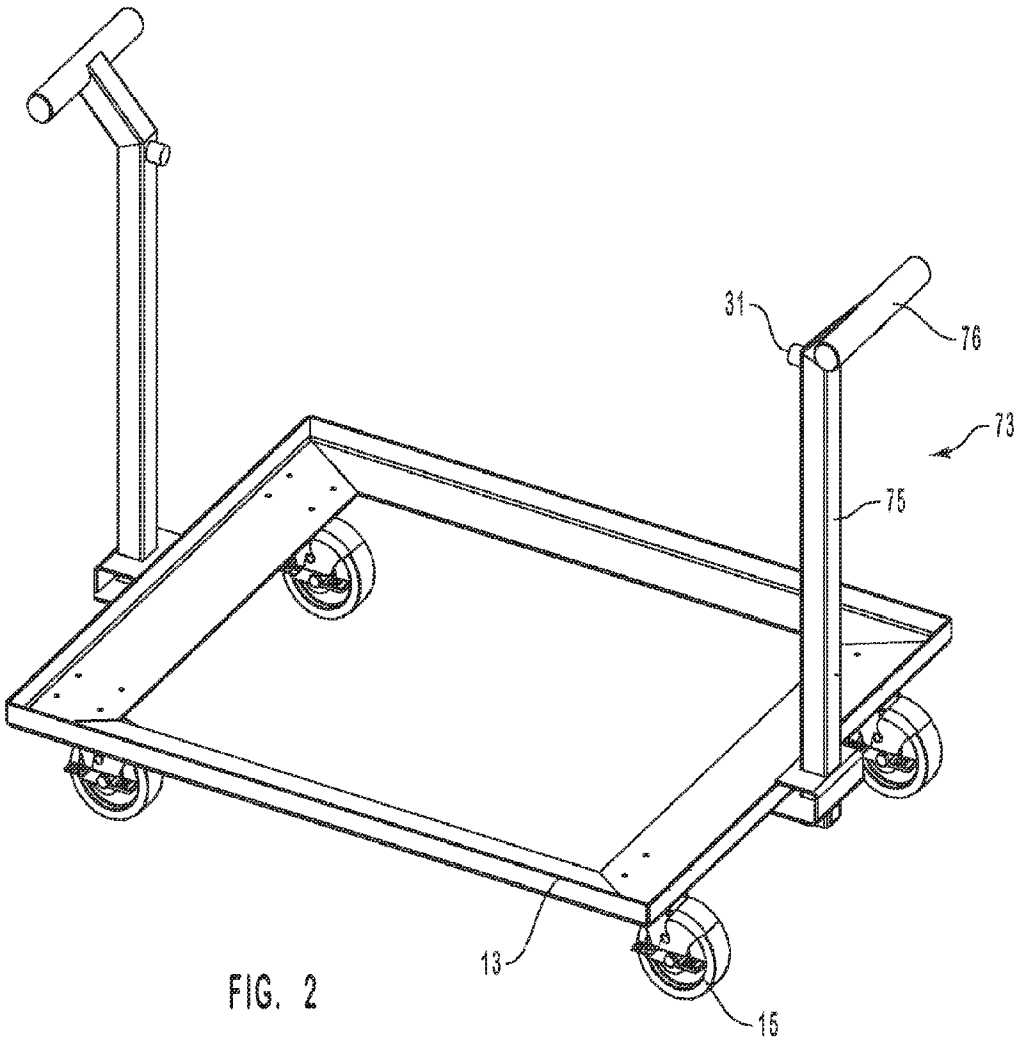
FIG. 2 is a perspective view of an alternative embodiment of a dolly.

Depicted in FIG. 2 is an alternative embodiment of a dolly 73. Dolly 73 includes frame 13 adapted to receive bin assembly 10. Mounted on frame 13 are wheels 15. In contrast to U-shaped handles 27, however, dolly 73 includes a singular stand 75 upstanding from each end of frame 13. A handle 76 outwardly projects from an upper end of each stand 75. Projecting from each stand 75 is bumper 31 which is again adapted to bias against bin 12 so as to support stands 75.

Returning to FIG. 1, in one embodiment of the present invention means are provided for enabling bin 12 to be lifted by a forklift. By way of example and not by limitation, fluid bin assembly 10 also includes a pair of spaced apart forklift channels 23A and B extending between two adjacent legs 16 in alignment with corresponding sides of bin 12. Each forklift channel 23 bounds an opening 25 that longitudinally extends therethrough. A pair of spaced apart openings 28 also transversely extend through each forklift channel 23. Each of openings 25 and 28 are adapted to receive a fork from a forklift. A motorized or hand operated forklift can thus be used to easily lift and move fluid bin assembly 10 by inserting the forks of the forklift within openings 25 or 28 from any side of bin assembly 10.

It is appreciated that the forklift channels can come in a variety of different configurations and can be mounted in a variety of different ways. Other examples of forklift channels will be provided below with regard to other embodiments. For example, in the embodiment depicted in FIG. 12, forklift channels 23 are mounted directly on the bottom of legs 16 as opposed to the sides thereof.

Bin 12 comprises a floor 26 (FIG. 5) having an encircling side wall 17 upstanding therefrom. Side wall 17 includes a front panel 18, an opposing back panel 19, and a pair of spaced apart side panels 20 and 21 extending therebetween. In one embodiment legs 16 are positioned at each corner of bin 12 and are used to secure together adjacently disposed edges of panels 18-21. Legs 16 and panels 18-21 can be secured together using conventional techniques such as welding, rivets, bolts, adhesive, screws, or the like. In such embodiments, legs 16 can form a portion of side wall 17. In other embodiments, panels 18-21 can be directly secured together using conventional techniques. In such embodiments, legs 16 need not form a portion of side wall 17.

It is appreciated that legs 16 can come in any number of sizes, shapes, and configurations. Legs 16 elevate bin 12 for convenient use and, as will be discussed below, enable access to the bottom of bin 12. Any structure that enables access to the bottom of bin 12 can also be used to replace legs 16. For example, instead of only being disposed at the corners, two legs 16 can be formed that extend along each side of bin 12. In another embodiment, a single continuous leg can downwardly project from the bottom of bin 12. An opening can be formed through the leg to provide access to the bottom of bin 12. In still other embodiments, legs 16 can be formed that project directly from the bottom surface of bin 12.

In the embodiment depicted, each leg 16 comprises an elongated first panel 54 and an elongated second panel 55 that orthogonally intersect along a corner 56. Each of panels 54 and 55 extend between an upper end 57 and an opposing lower end 58. Upwardly and outwardly projecting from each panel 54 and 55 at upper end 57 is a retention tab 59. Extending through at least some of retention tabs 59 is a hole 61. As perhaps best depicted in FIG. 11, each leg 16 has a horizontally disposed base 63 disposed at lower end 58. Extending through each panel 54 and 55 adjacent to base 63 is an opening 65. Base 63 is notched in alignment with each opening 65.

Figure 3:
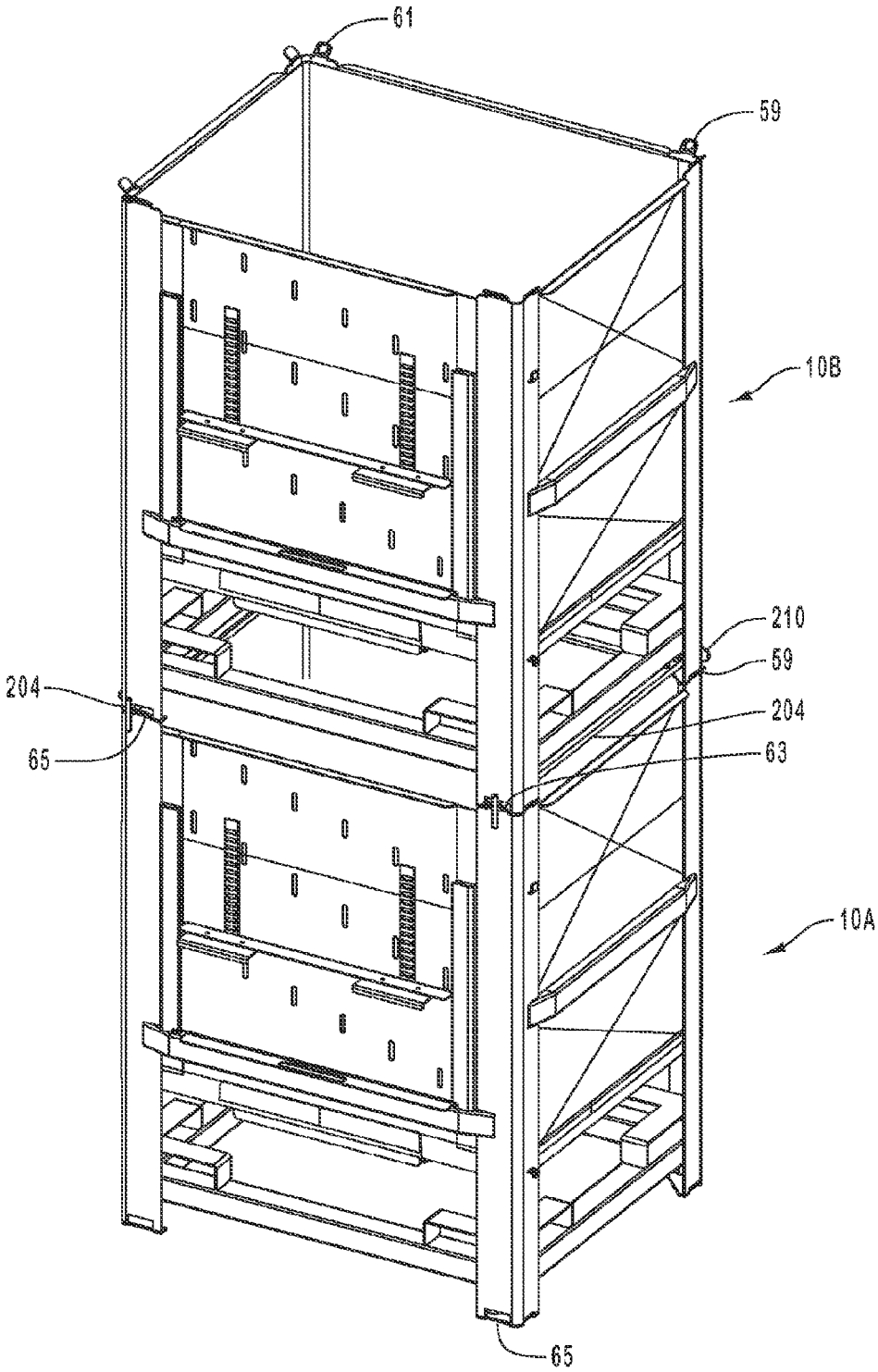
FIG. 3 is a perspective view of a pair of stacked fluid bin assemblies.

The above configuration for legs 16 enables fluid bin assemblies 10 to be stacked such as during storage or transport. Specifically, as depicted in FIG. 3, a bin assembly 10B is stacked above a bin assembly 10A such that each retention tab 59 of bin assembly 10A is seated within a notch of a corresponding base 63 of bin assembly 10B. Each tab 59 is also aligned with a corresponding opening 65. Retention tabs 59 are sloped so that bases 63 can slide thereon during placement. As a result, tabs 59 assist in automatic alignment and positioning of the stacked bin assemblies.

Figure 4:
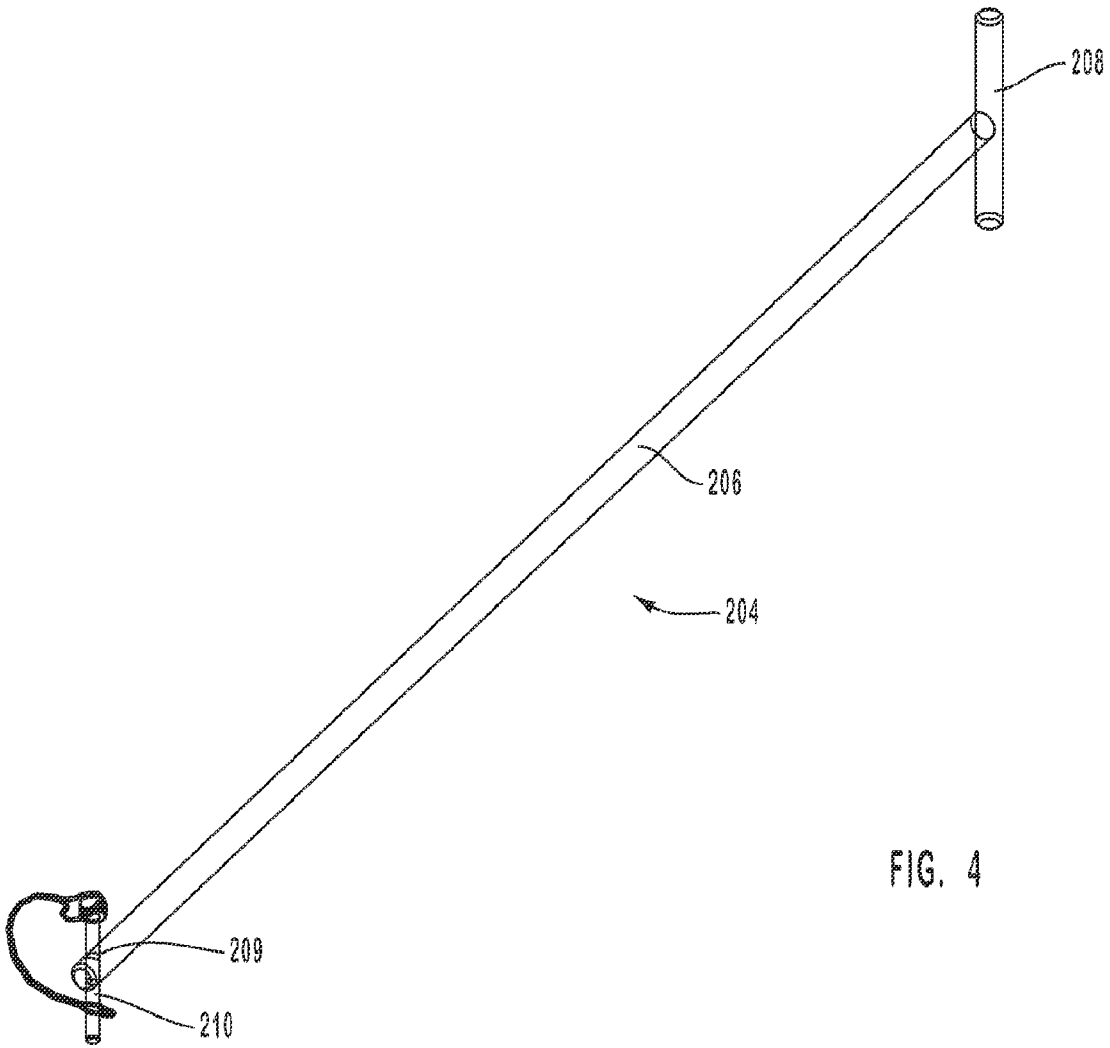
FIG. 4 is a perspective view of a tie rod used to secure the stacked fluid bin assemblies of FIG. 3.

Depicted in FIG. 4 is one embodiment of a tie rod 204. Tie rod 204 comprises an elongated shaft 206 having a handle 208 outwardly projecting from a first end thereof. A hole 209 extends through an opposing second end of shaft 206. Hole 209 is designed to receive a latch pin 210 therein. As shown in FIG. 3, once bin assembles 10A and 10B are stacked, tie rod 204 is advanced through the aligned holes 61 in retention tabs 59 and openings 65. Latch pin 210 is then passed through hole 209, thereby securing together bin assemblies 10A and 10B.

Figure 12:
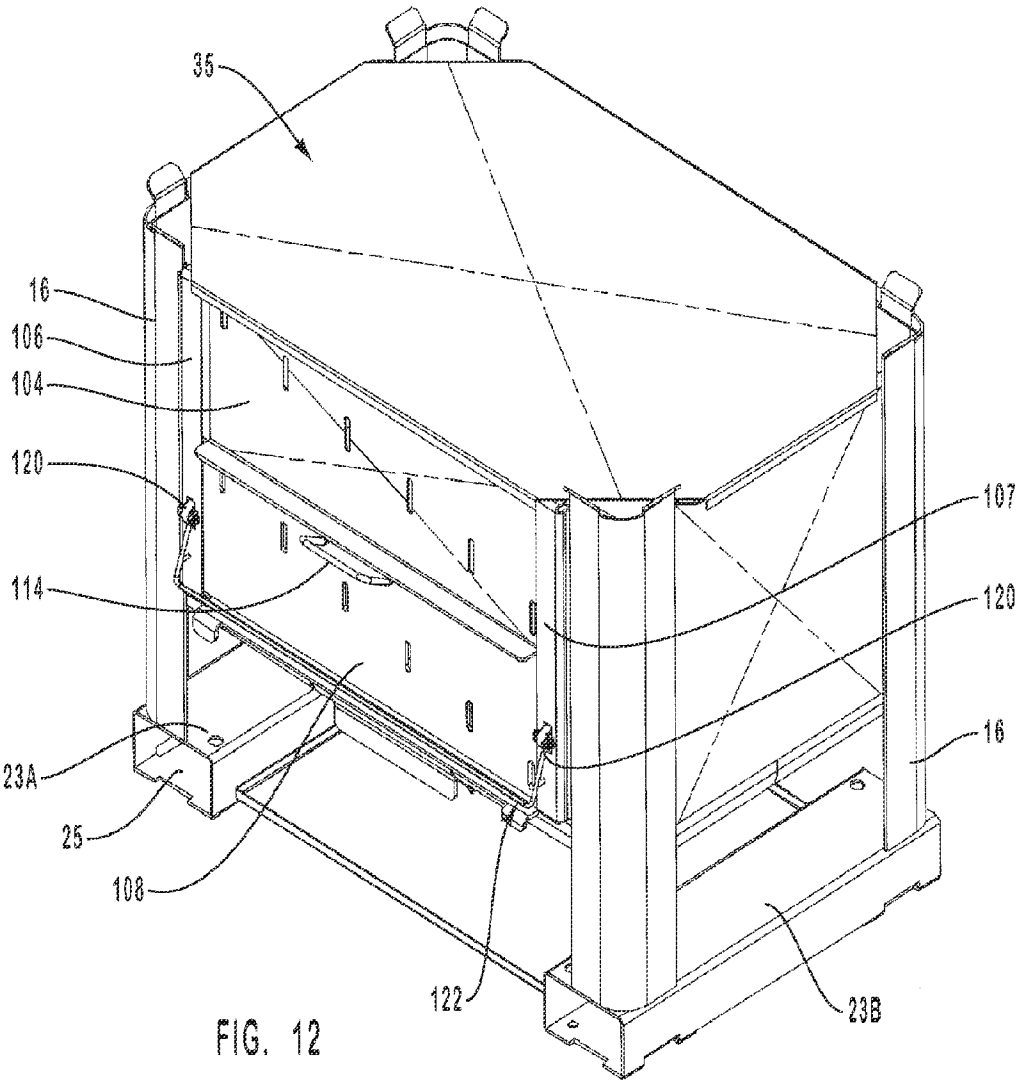
FIG. 12 is a top perspective view of another alternative embodiment of the fluid bin assembly shown in FIG. 1.

Returning to FIG. 1, panels 18-21 and side wall 17 each have an upper end 22 and an opposing lower end 24. Upper end 22 of side wall 17 terminates at an upper edge 34. Bin 12 has an interior surface 30 which bounds a chamber 32. Horizontally and vertically staggered slots 37 extending through side wall 17 allow visual determination of a fluid level within chamber 32. Upper edge 34 bounds a top opening 36 which communicates with chamber 32. A lid 35, as shown in FIG. 12, can be used to selectively cover top opening 36 to chamber 32.

Figure 13:
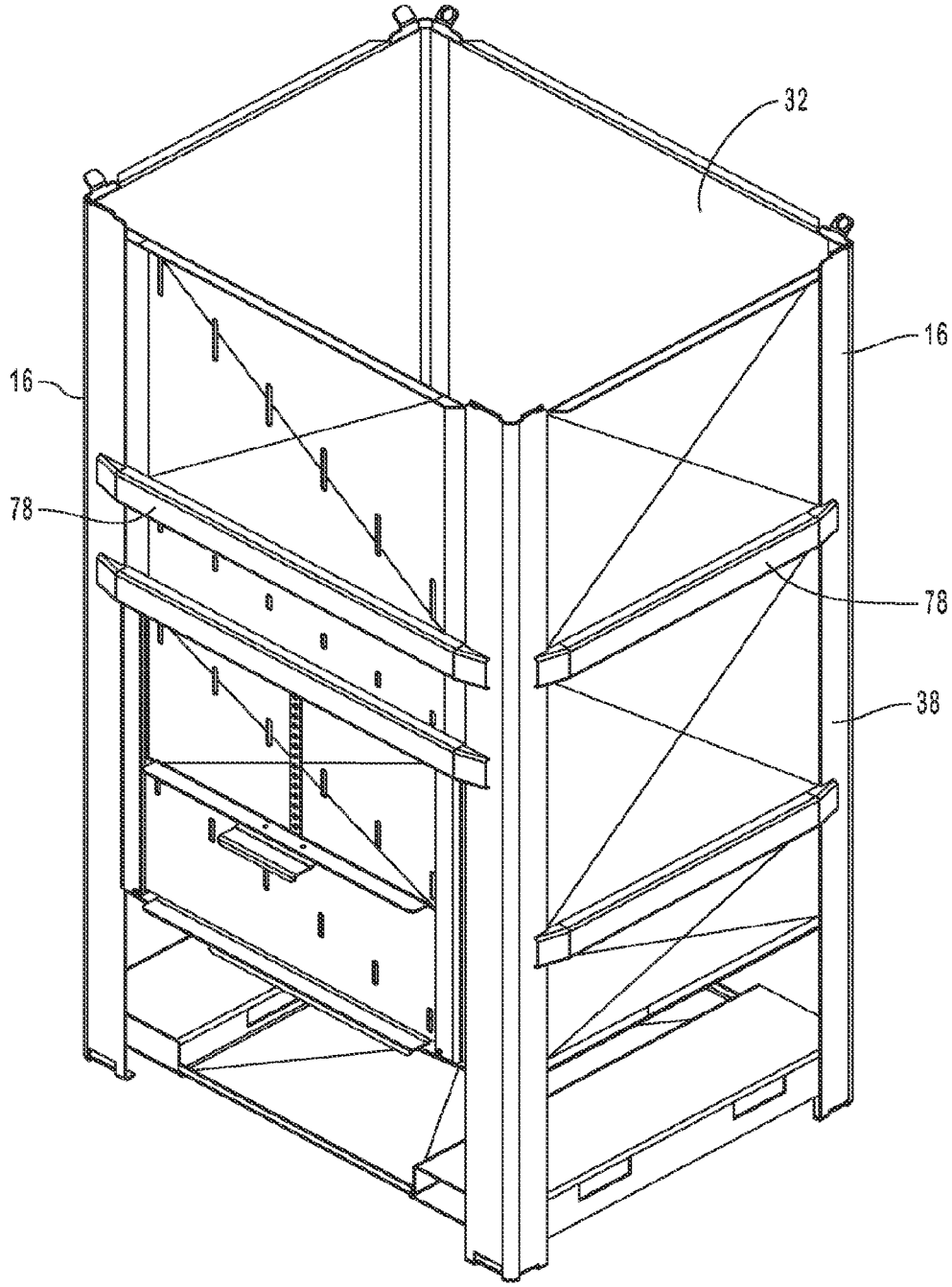
FIG. 13 is a perspective view of an enlarged fluid bin assembly.

Chamber 32 can be any desired volume. For example, depicted in FIG. 13 is an enlarged bin 38 having a chamber 32 with increased volume. By way of example and not by limitations, bins can be formed having a chamber 32 with a volume of 500 liters, 1,000 liters, 1,500 liters or any other desired volume. It is noted that in the embodiment depicted in FIG. 13, reinforcing members 78 are mounted along each side of bin 38 so as to extend between legs 16. Reinforcing members 78 are used to increase the hoop strength of bin 38.

Bin 12 can be comprised of metal, such as stainless steel, fiberglass, composites, plastic, or any other desired material. Furthermore, although bin 12 is shown as having a substantially box shaped configuration, bin 12 can be any desired configuration or have a transverse configuration that is polygonal, elliptical, irregular, or any other desired configuration.

Figure 5:
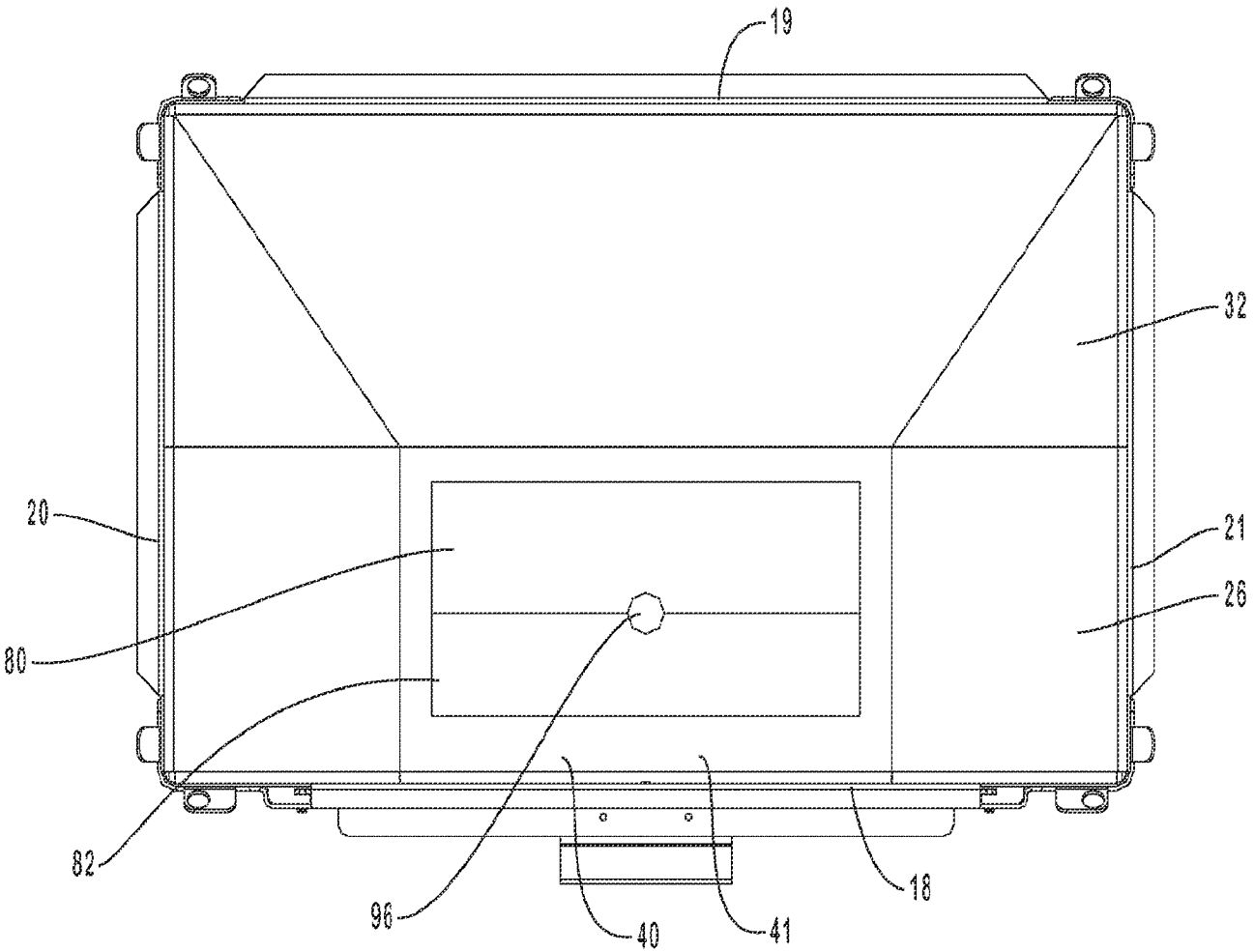
FIG. 5 is a top plan view of the fluid bin assembly shown in FIG. 1.
Figure 6:
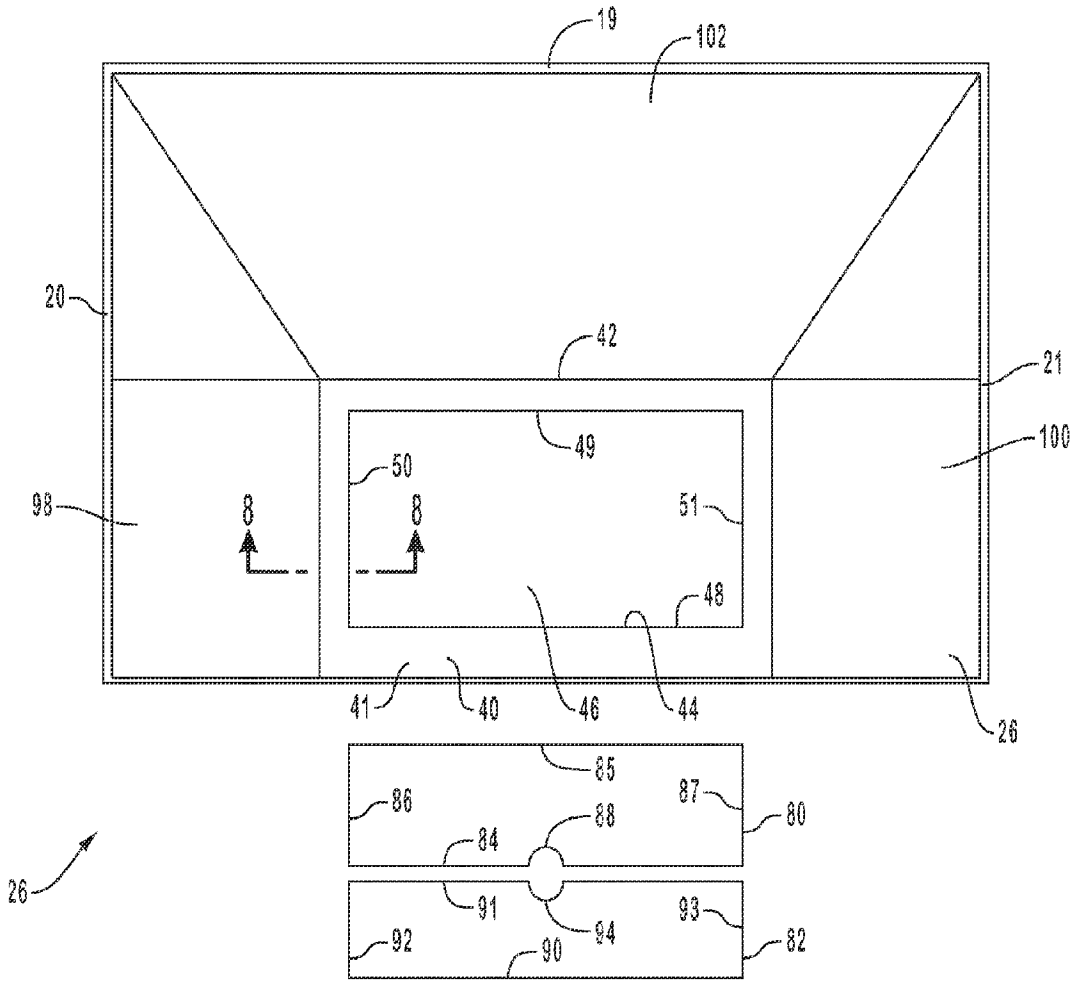
FIG. 6 is a top plan view of the floor of the fluid bin assembly shown in FIG. 1 with the retention plates exploded therefrom.
Figure 7:
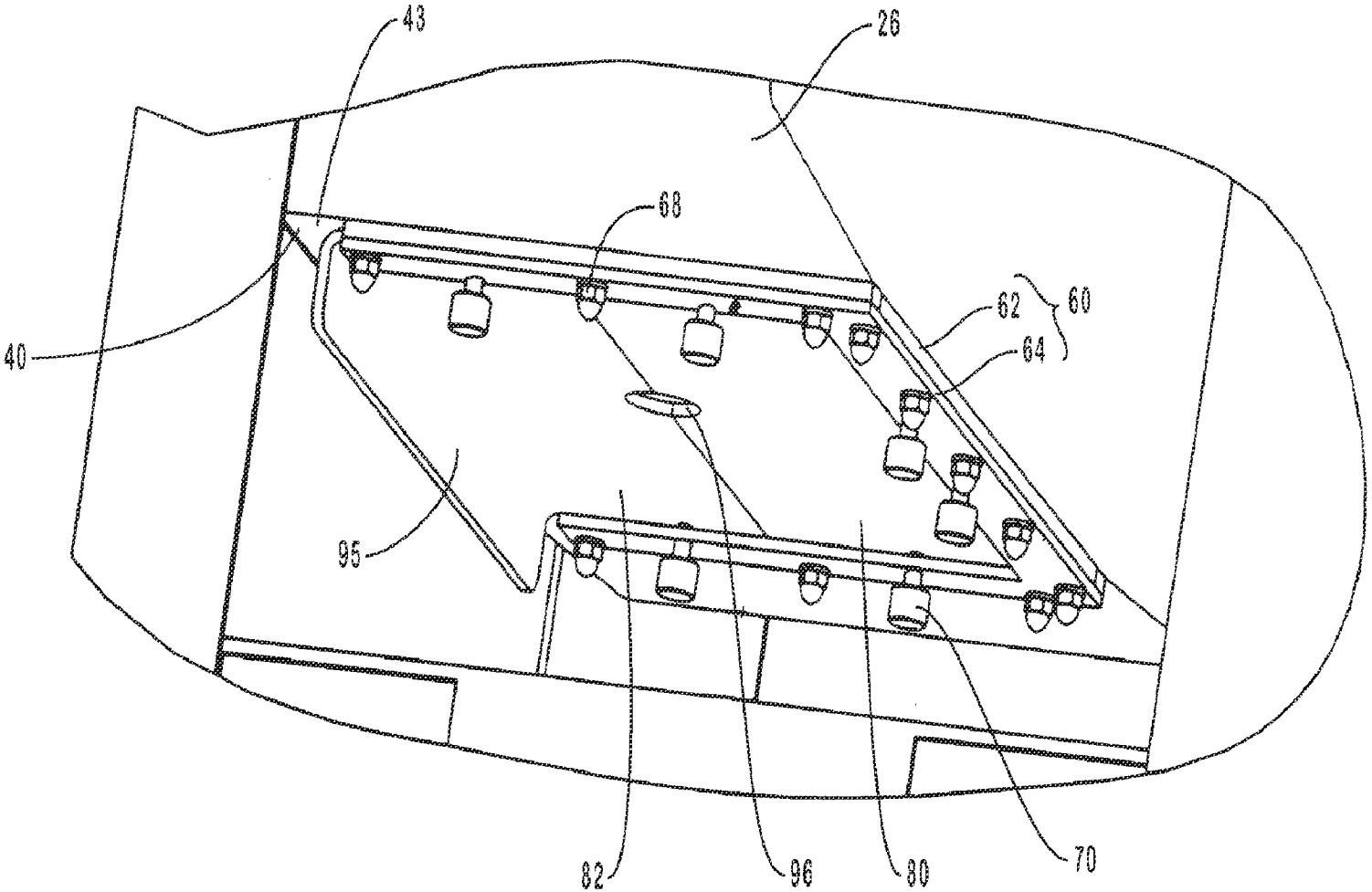
FIG. 7 is a bottom perspective view of the bin of the fluid bin assembly shown in FIG. 1.

As depicted in FIG. 5, floor 26 comprises a substantially flat base floor 40 having a top surface 41 and an opposing bottom surface 43 (FIG. 7). Base floor 40 is centrally disposed along front panel 18 and projects from front panel 18 toward back panel 19. Depicted in FIG. 6, base floor 40 has an outer edge 42 and an inner edge 44. Floor 26 further comprises a first side floor 98 that downwardly slopes from side panel 20 to base floor 40, a second side floor 100 that downwardly slopes from side panel 21 to base floor 40, and a back floor 102 that downwardly slopes from back panel 19 to base floor 40. As a result, floor sections 98, 100, and 102 are sloped to direct or funnel material to base floor 40. In an alternative embodiment, all of floor 26 can be substantially flat.

Figure 8:
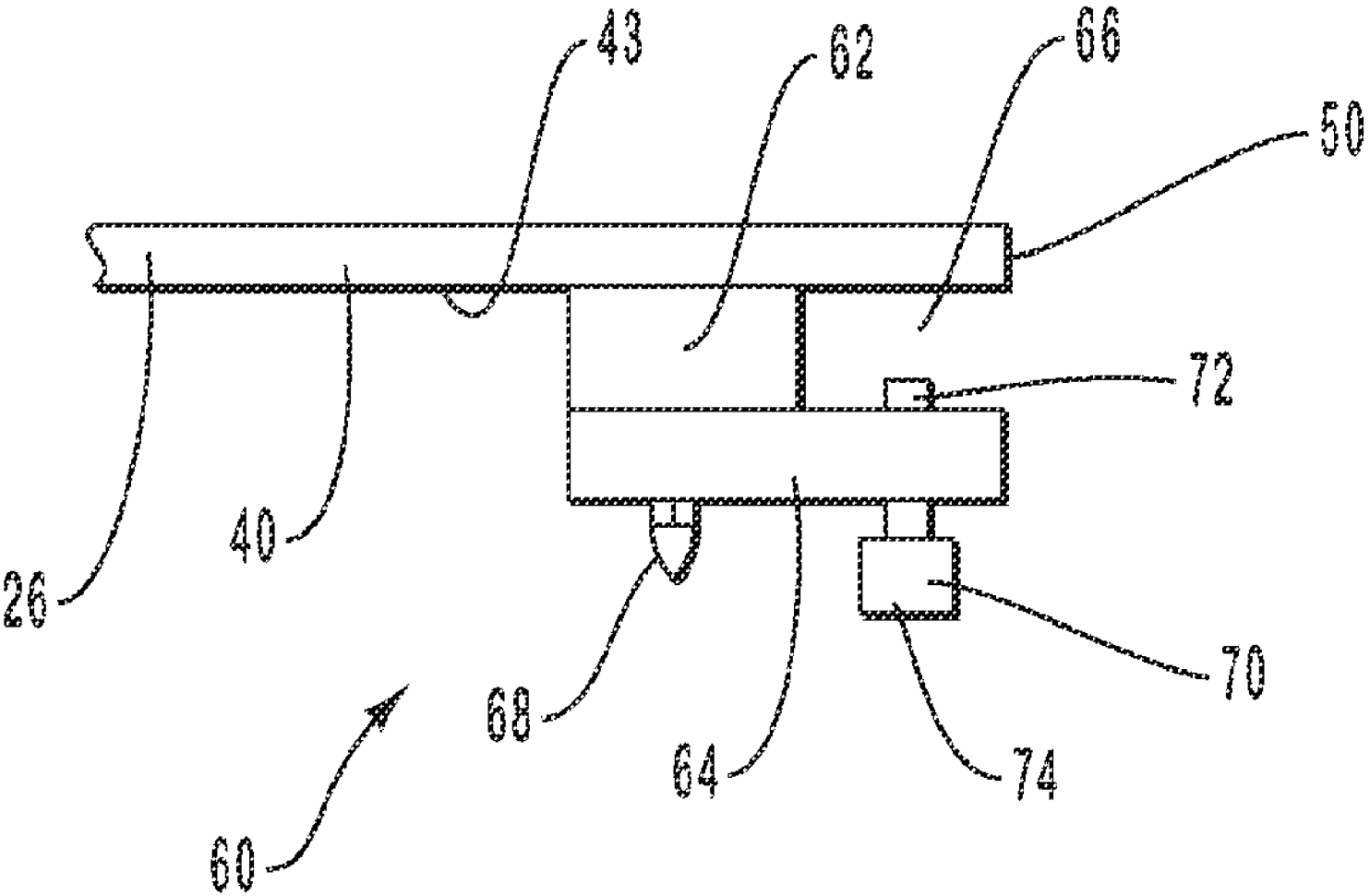
FIG. 8 is a cross sectional side view of a section of the bin shown in FIG. 6 taken along section lines 8-8.
Figure 9:
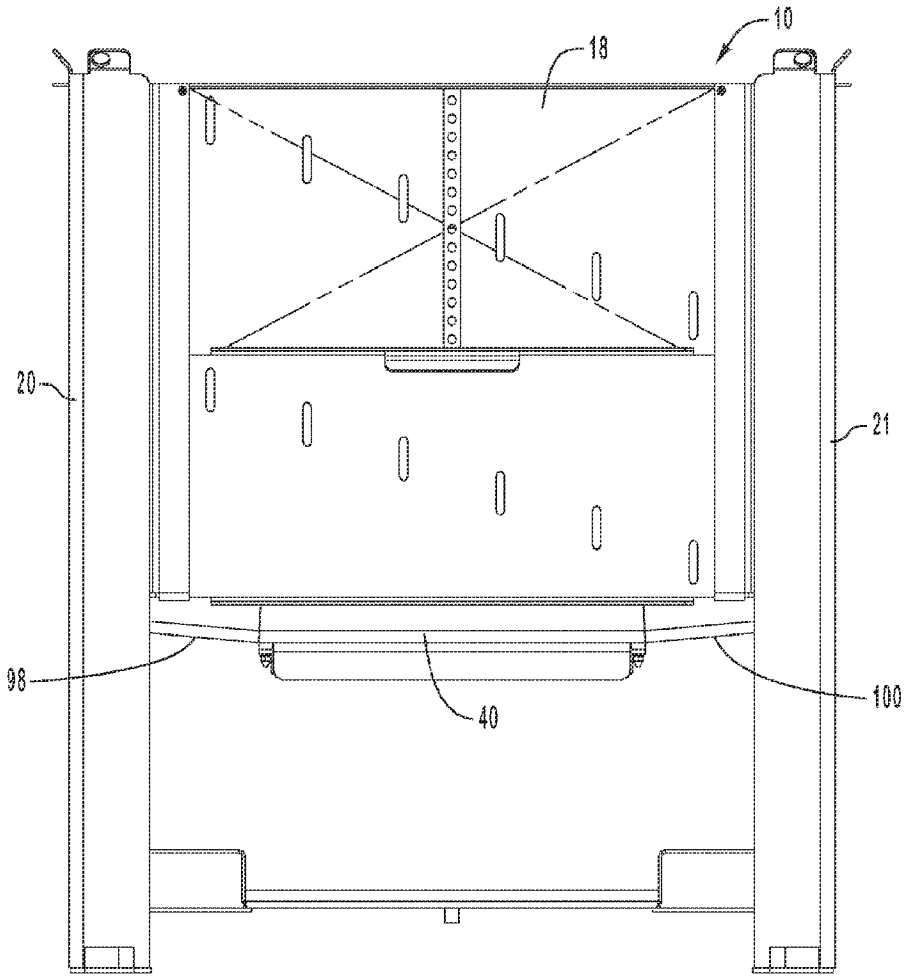
FIG. 9 is an elevated front view of the fluid bin assembly shown in FIG. 1.

Inner edge 44 of base floor 40 bounds an opening 46 extending through base floor 40. Inner edge 44 includes a front edge portion 48, a back edge portion 49, and opposing side edge portions 50 and 51. Depicted in FIG. 7, mounted on bottom surface 43 of base floor 40 is a bracket assembly 60. Bracket assembly 60 extends along edge portions 49-51 of base floor 40 so as to have a substantially U-shape configuration. As depicted in FIGS. 7 and 8, bracket assembly 60 includes a flat elongated spacer 62 that is disposed directly on bottom surface 43 of base floor 40 but at a distance back from edge portions 49-51. Mounted on top of spacer 62 is an elongated substantially flat slide rail 64. Slide rail 64 extends along spacer 62 but also outwardly projects therefrom so as to extend out to edge portions 48-50. As a result, a channel 66 is formed between slide rail 64 and base floor 40 along edge portions 49-51 of base floor 40. It is appreciated that slide rail 64 need not extend all the way to edge portions 48-50 but need merely extend beyond spacer 62 toward edge portions 48-50.

Spacer 62 and slide rail 64 can each comprise multiple discrete members or can each be a single integral member. Furthermore, spacer 62 and slide rail 64 can be formed as a combined integral member. Bolts 68 secure spacer 62 and slide rail 64 to base floor 40. A plurality of fasteners 70 each include a threaded shaft 72 having a knob 74 mounted on an end thereof. For reasons as will be discussed below in greater detail, shaft 72 threadedly engages with slide rail 64 and passes therethrough so as to communicate with channel 66.

Selectively and slideably disposed within channel 66 so as to substantially cover opening 46 in base floor 40 is at least one retention plate. For example, depicted in FIGS. 6 and 7, slideably disposed within channel 66 is a first retention plate 80 and a second retention plate 82. First retention plate 80 includes a front edge 84, a back edge 85, and opposing side edges 86 and 87. A substantially U-shaped recess 88 is centrally formed on front edge 84 of first retention plate 80. Similarly, a second retention plate 82 includes a front edge 90, back edge 91, and opposing side edges 92 and 93. A U-shaped recess 94 is formed on back edge 91 of second retention plate 82. A handle 95 downwardly extends from front edge 90 of second retention plate 82.

First and second retention plates 80 and 82 are removably slid within channel 66 so as to substantially cover opening 46. Recesses 88 and 94 are aligned so as to combine to form an annular porthole 96. Once plates 80 and 82 are received within channel 66, fasteners 70 can be tightened so as to secure plates 80 and 82 therein. As will be discussed below in greater detail, porthole 96 is used to receive a port and/or tube of a fluid bag received within chamber 32 of bin 12.

In one embodiment of the present invention means are provided for removably mounting retention plates to the bottom surface of floor 26. Bracket assembly 60 is one embodiment of such means. It is appreciated, however, that a variety of alternative structures can replace bracket assembly 60. By way of example and not by limitation, the retention plates could be directly screwed or bolted to the bottom surface of floor 26. Alternatively, once retention plates are positioned, hinged fasteners could be rotated so as to bias against and secure the retention plates. In still other embodiments, braces could be positioned to selectively bias against the retention plates when in place.

Returning to FIG. 1, front panel 18 comprises a fixed panel 104 and a door 108. Fixed panel 104 at least partially bounds a doorway 105 (see FIG. 22) which is selectively opened and closed by door 108. Specifically, a pair of opposing tracks 106 and 107 vertically extend along opposing sides of front panel 18. Door 108 is slideably disposed within tracks 106 and 107. Door 108 can be selectively raised so that doorway 105 is opened on front panel 18, thereby allowing communication with chamber 32.

Figure 10:
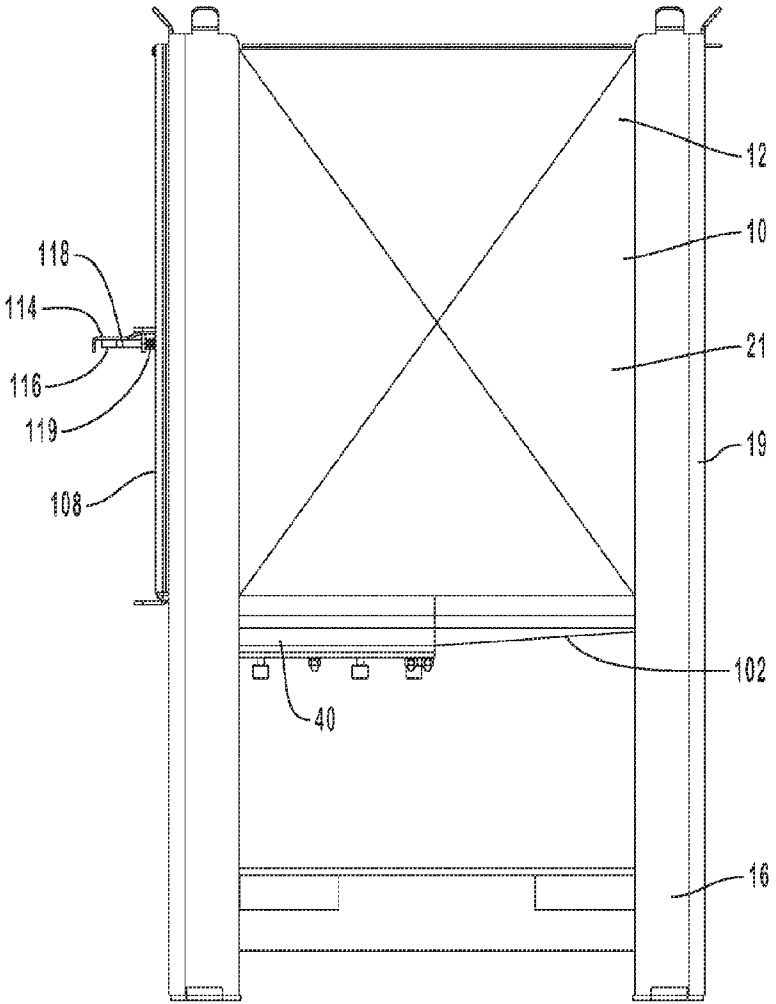
FIG. 10 is an elevated side view of the fluid bin assembly shown in FIG. 1.

In one embodiment of the present invention, means are provided for selectively retaining door 108 at a desired raised location. By way of example and not by limitation, a locking track 110 is centrally formed on fixed panel 104 in a vertical orientation. A plurality of spaced apart holes 112 are formed on locking track 110. A handle 114 is formed on and outwardly projects from a top end of door 108. Depicted in FIG. 10, a spring biased lever 116 is slideably disposed adjacent to handle 114. A rod 118 projects from lever 116 and extends through door 108 so as to engage a select hole 112. By grabbing handle 114 and pulling back on lever 116, rod 118 is retracted from the hole 112 allowing door 108 to freely slide up and down along tracks 106 and 107. When a desired position for door 108 is reached, lever 116 is released. A spring 119 then forwardly biases rod 118 so that rod 118 is again received within a hole 112 of locking track 110, thereby selectively locking door 108 in the desired location.

Figure 11:
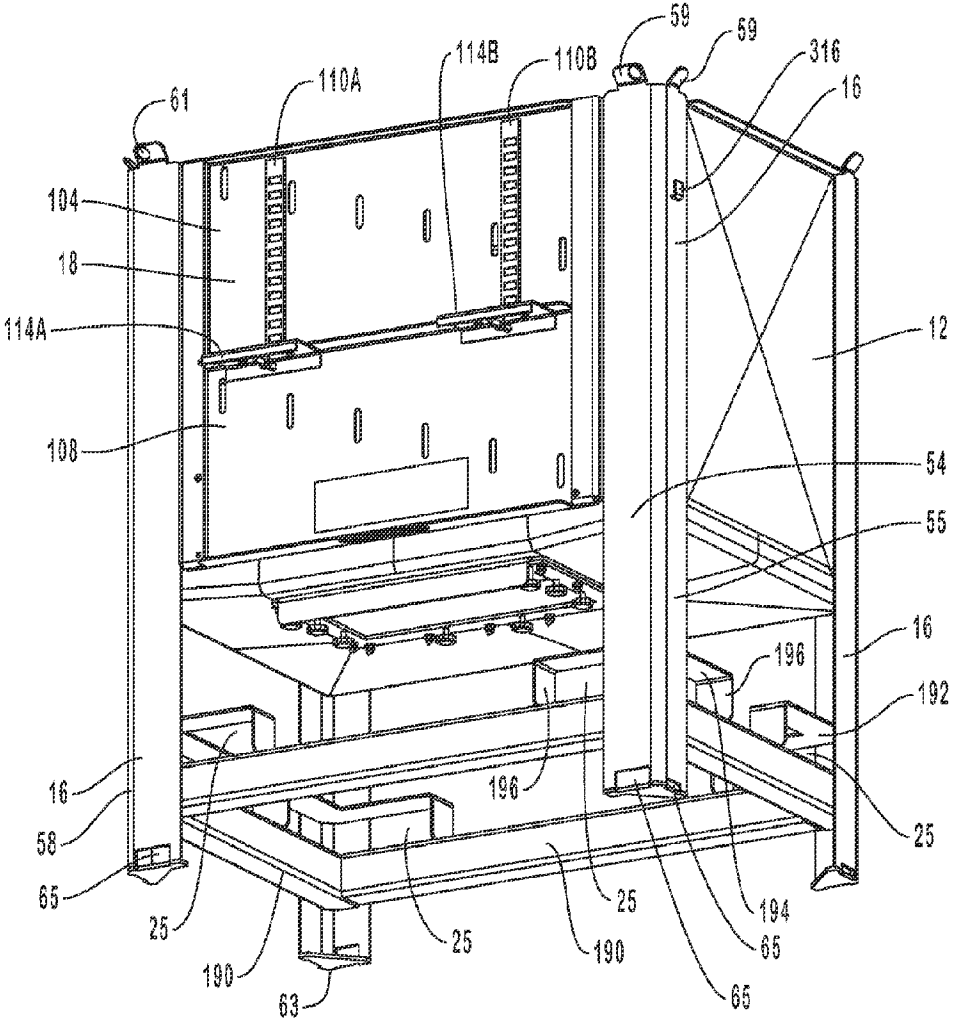
FIG. 11 is a bottom perspective view of an alternative embodiment of the fluid bin assembly shown in FIG. 1.

In one alternative as depicted in FIG. 11, two spaced apart tracks 110A and 110B are formed on fixed panel 104. Corresponding handles 114A and B with related locking structures are mounted on door 108. FIG. 11 also depicts another alternative embodiment of the means for enabling bin 12 to be lifted by a forklift. Specifically, cross bars 190 extend between each of legs 16 at lower ends thereof. A bracket 192 is mounted to each leg 16 and connects with each of the cross bars 190 that intersect with the corresponding leg 16.

Specifically, each bracket 192 comprises a substantially L-shaped body 194. Body 194 is centrally mounted to a leg 16 at a distance above cross bars 190. Body 194 is positioned so that the arms thereof project in parallel alignment with the cross bars 190 that intersect with the leg 16. Supports 196 downwardly project from each end of body 194 and engage with the corresponding cross bars 190. As a result, brackets 192 and cross bars 190 combine to form a pair of spaced apart openings 25 along each cross bar 190. Each opening 25 is sized to receive a fork from a forklift. In this embodiment, a forklift can engage with the fluid bin assembly from any side of the assembly. In yet other embodiments, it is appreciated that openings 25 for the forks of a fork lift can be made from a variety of other types of channels, brackets, plates and the like.

Depicted in FIG. 12 is another embodiment of the means for selectively retaining door 108 at a desired raised location. As shown therein, an eccentric cam 120 is rotatably mounted on each of tracks 106 and 107. A substantially U-shaped bar 122 extends between each of cams 120. When bar 122 is raised, cams 120 disengage from door 108 allowing door 108 to be freely raised and lowered. When at a desired location, bar 122 is lowered causing cams 120 to engage against door 108, thereby retaining door 108 at the desired location. It is appreciated that there are a variety of other conventional locks, latches, stops, and the like that can be used to secure door 108 at a desired location.

Figure 14:
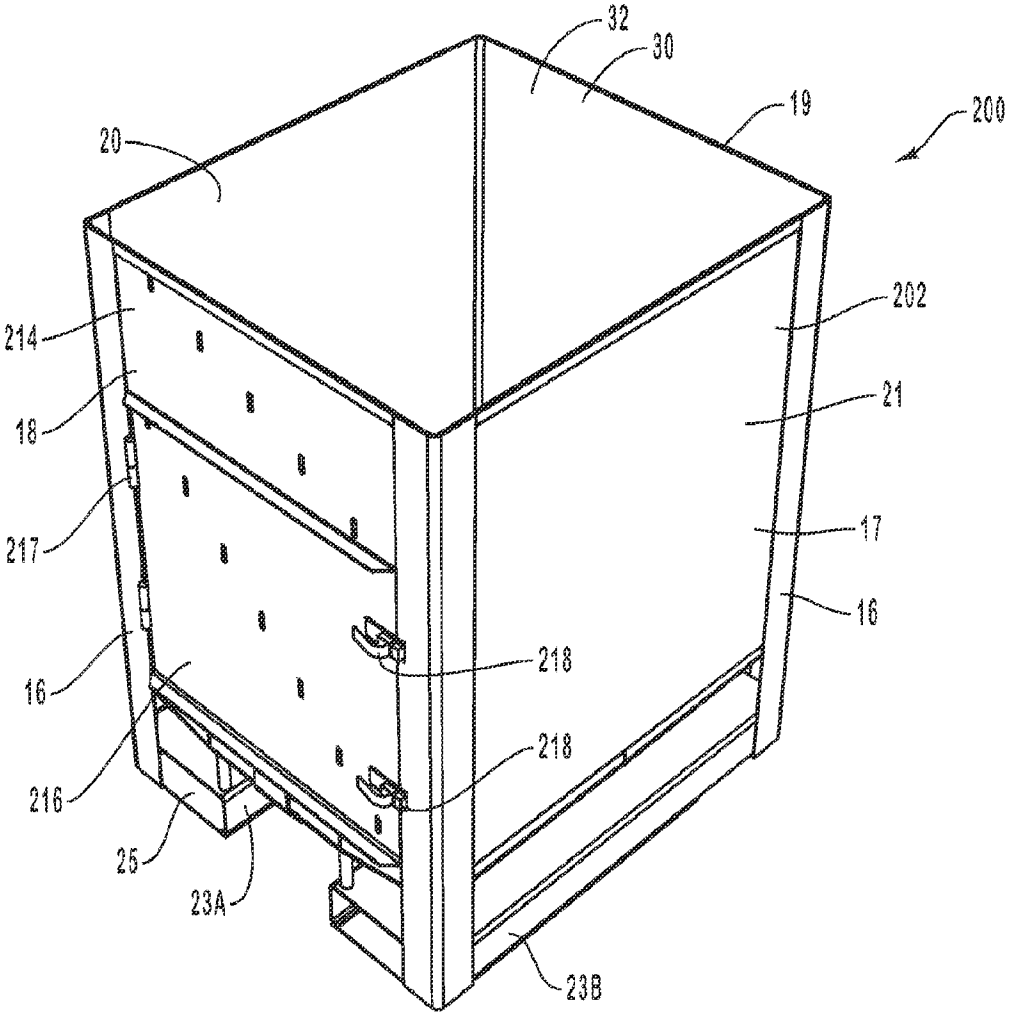
FIG. 14 is a perspective view of a fluid bin assembly having a hinged door.

Depicted in FIGS. 14-19 is another alternative embodiment of a fluid bin assembly 200 incorporating features of the present invention. It is appreciated that in all alternative embodiments, like features are identified by like reference characters. Turning to FIG. 14, fluid bin assembly 200 comprises bin 202 which includes floor 26 (FIG. 15) and panels 18-21. In contrast to bin 12, however, front panel 18 of bin 202 comprises a fixed panel 214 and a door 216. Fixed panel 214 bounds a doorway 219 (FIG. 16) which is selectively opened and closed by door 216. Specifically, door 216 is mounted to fixed panel 214 by hinges 217. Latches 218 mounted on the opposing side of door 216 selectively lock door 216 to fixed panel 214. Door 216 can thus be hingedly opened and closed so as to enable access to chamber 32 and floor 26 of bin 202 through doorway 219.

Figure 15:
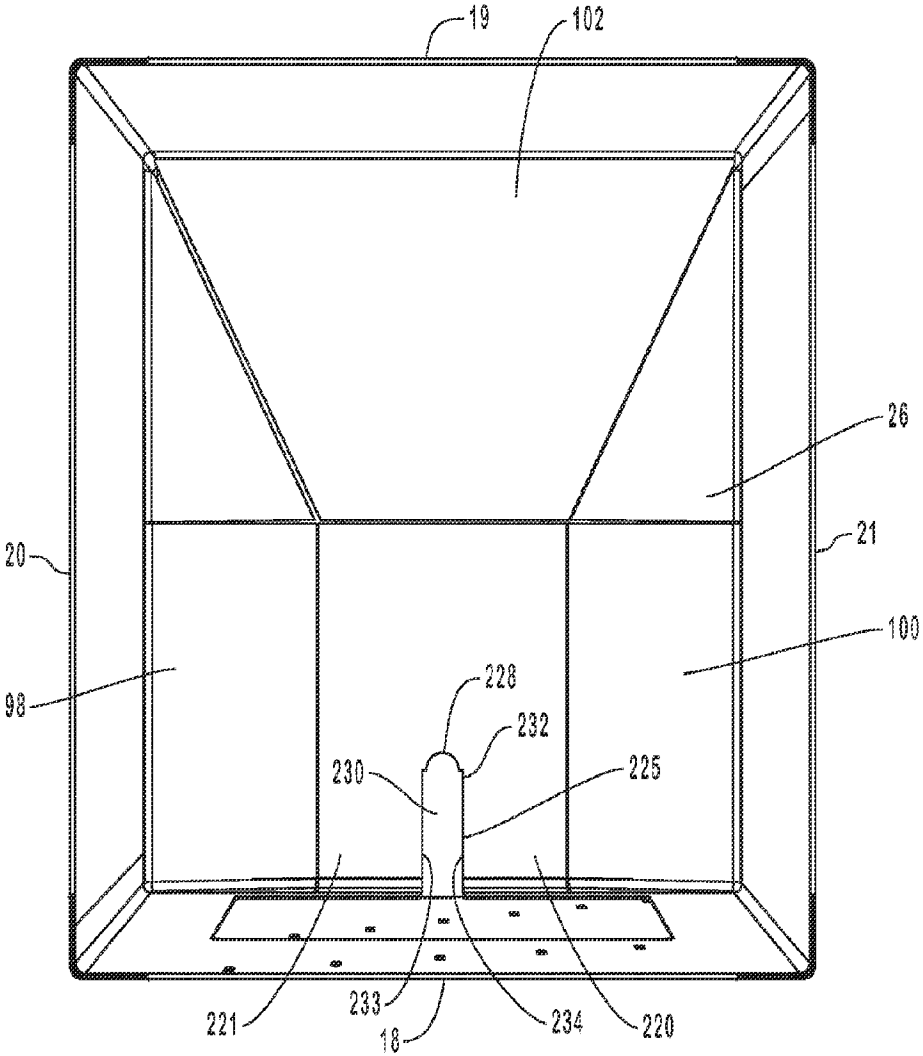
FIG. 15 is a top plan view of a fluid bin assembly shown in FIG. 14.
Figure 16:
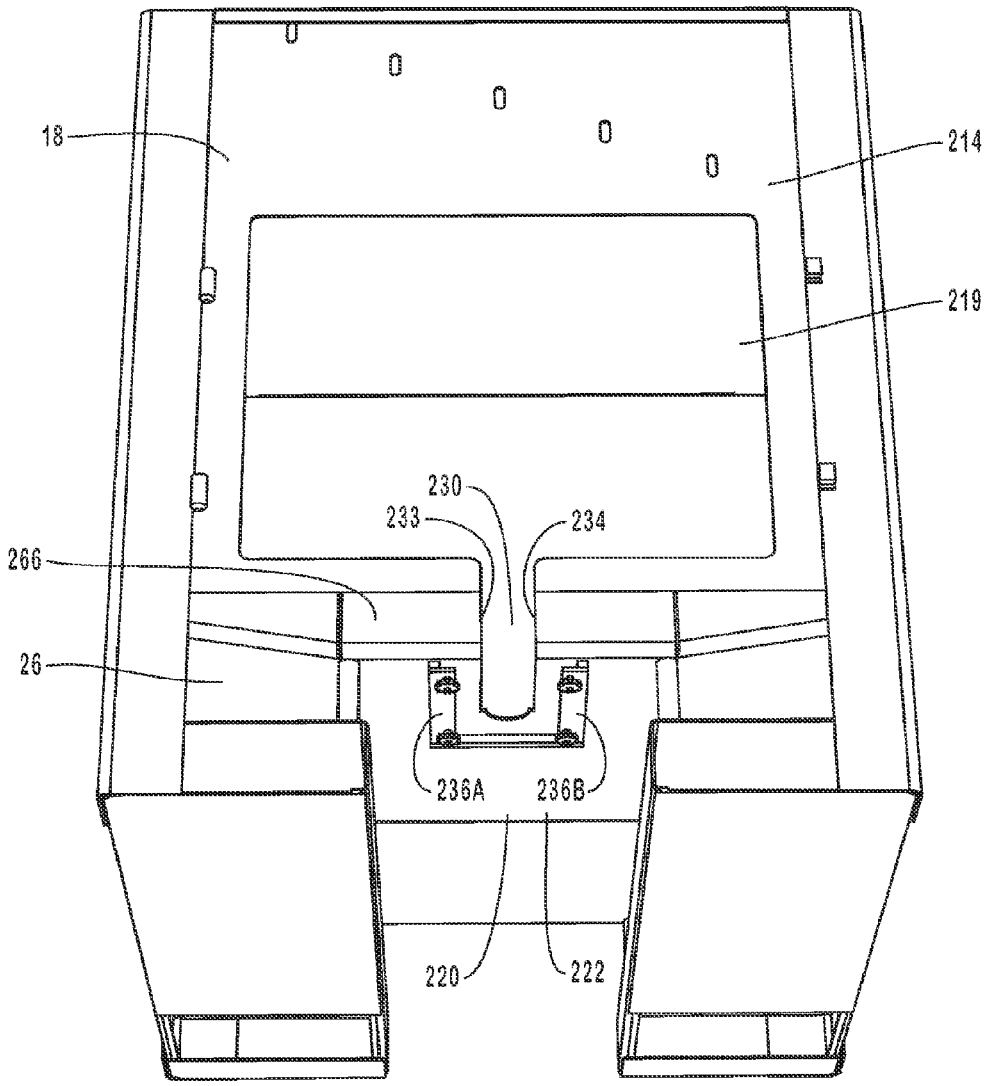
FIG. 16 is a bottom perspective view of the fluid bin assembly shown in FIG. 14 without the door or retention plate.

As depicted in FIGS. 15 and 16 (FIG. 16 being shown without door 216), floor 26 of bin 202 comprises a substantially flat base floor 220 having a top surface 221 and an opposing bottom surface 222. Base floor 220 is centrally disposed along front panel 18 and projects from front panel 18 toward back panel 19. Base floor 220 has an inner edge 225. Inner edge 225 of base floor 220 bounds slot 230 which extends through base floor 220. Inner edge 225 includes a back edge 232 and opposing side edges 233 and 234. A semi-circular notch 228 is formed on back edge 232. Depicted in FIG. 16, opposing side edges 233, 234 and slot 230 also extend along fixed panel 214 of front panel 198 so as to intersect with doorway 219. As such, slot 230 has a substantially L-shaped configuration.

Figure 17:
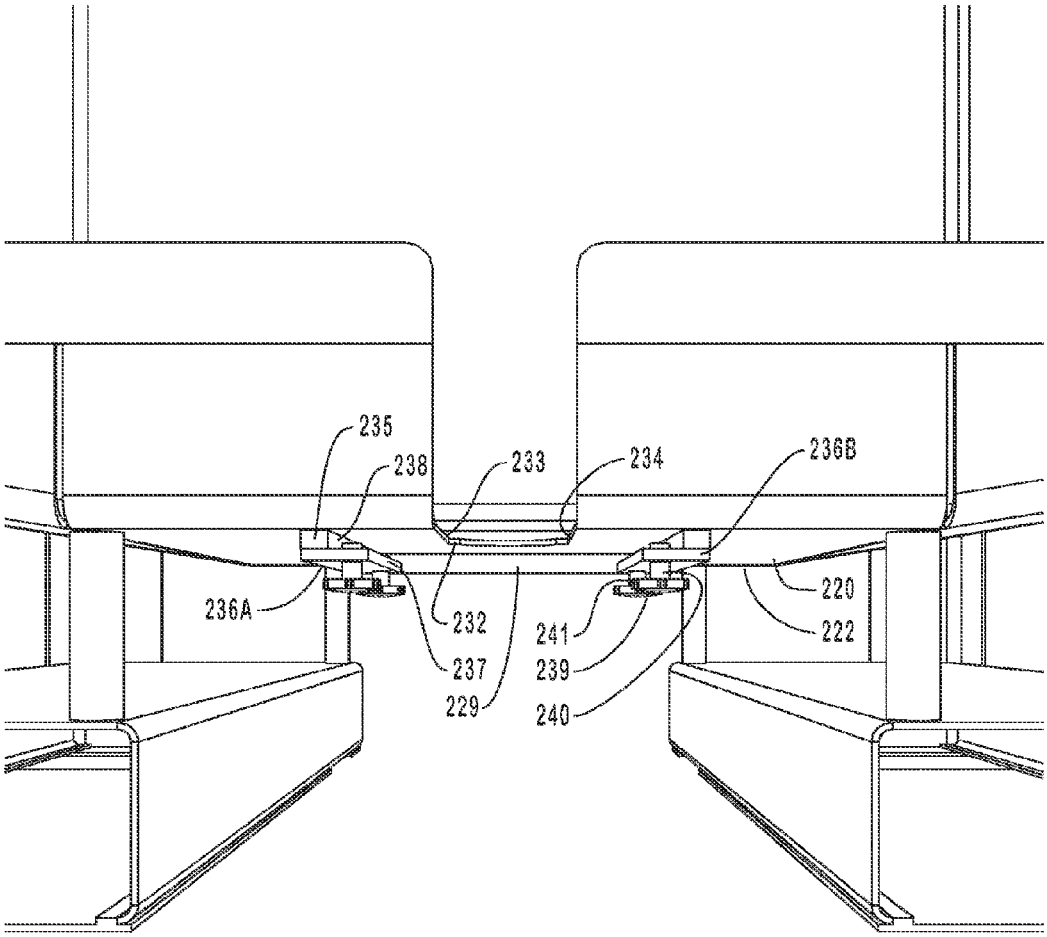
FIG. 17 is an enlarged elevated front view of a section of the fluid bin assembly shown in FIG. 16.

Depicted in FIGS. 16 and 17, mounted on bottom surface 222 of base floor 220 along-side edges 233 and 234 are bracket assemblies 236A and B. Each bracket assembly 236 includes a flat elongated spacer 235 that is disposed directly on bottom surface 222 of base floor 220 but at a distance back from side edges 233 and 234. A stop plate 229 extends between spacers 235 at a distance back from back edge 232. Mounted on top of spacer 235 is an elongated substantially flat slide rail 237. Slide rail 237 extends along spacer 235 but also outwardly projects therefrom so as to freely project out toward side edges 233 and 234. As a result, a channel 238 is formed between slide rail 237 and base floor 220 along-side edges 233 and 234 of base floor 220.

Spacer 235 and slide rail 237 can each comprise multiple discrete members or can each be a single integral member. Furthermore, spacer 235 and slide rail 237 can be formed as a combined integral member. Bolts, welding, or other types of fasteners can be used to secure spacer 235 and slide rail 237 to base floor 220. A plurality of securing fasteners 239 each include a threaded shaft 240 having a knob 241 mounted on an end thereof. Each shaft 240 threadedly engages with a corresponding slide rail 237 and passes therethrough so as to communicate with a corresponding channel 238.

Figure 18:
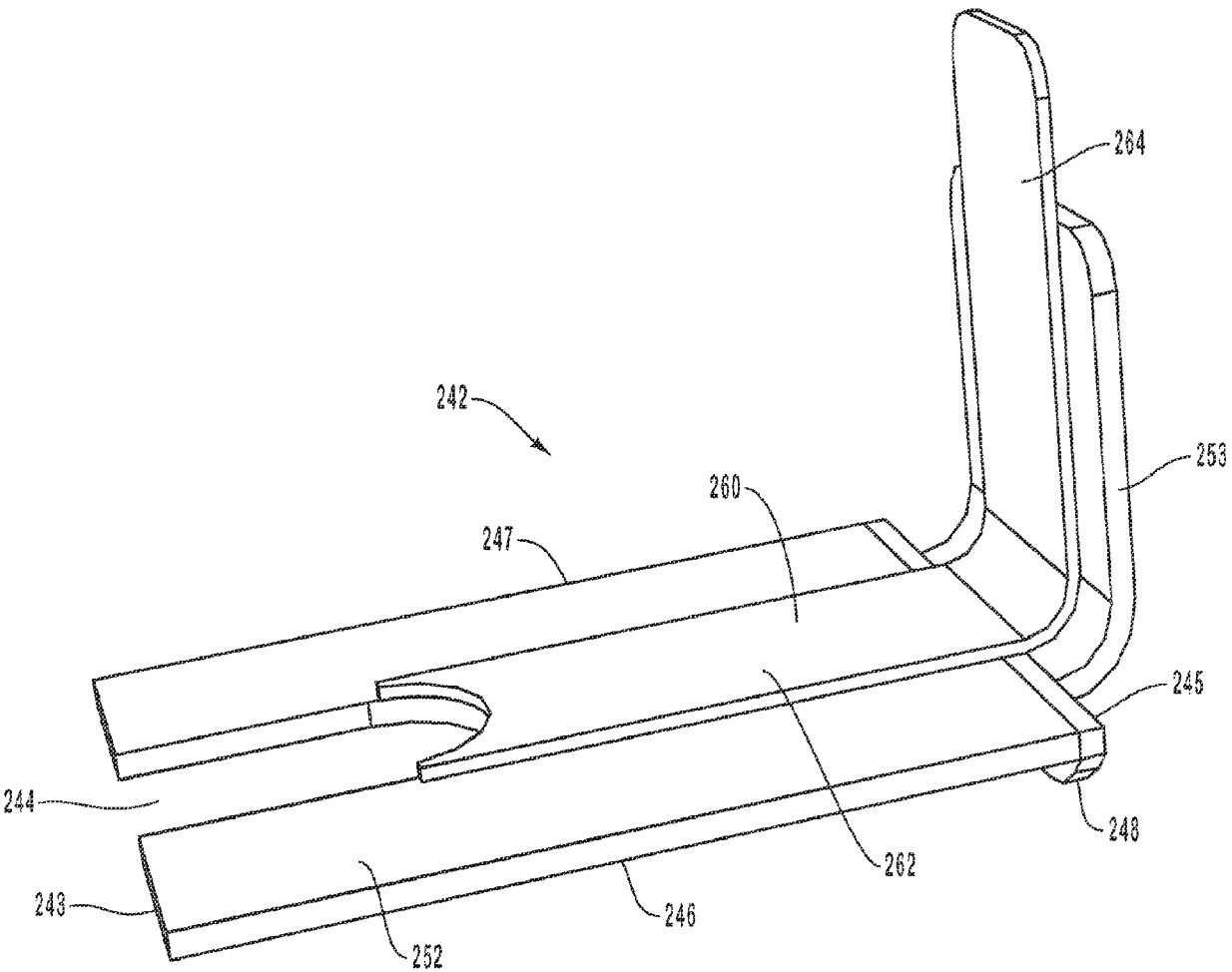
FIG. 18 is a perspective of the retention plate of the fluid bin assembly shown in FIG. 14.

Depicted in FIG. 18, support bin 184 also comprises a substantially L-shaped retention plate 242. Retention plate 242 comprises base plate 252 having a riser 253 upwardly projecting therefrom. Specifically, base plate 252 has a front edge 243, a back edge 245 and opposing side edges 246 and 247. A rounded notch 244 is formed on front edge 243 while a handle 248 downwardly projects from back edge 245. Riser 253 upwardly projects from back edge 245. A substantially L-shaped overlay 260 is mounted on base plate 252 and riser 253. Overlay 260 includes a base section 262 which extends on base plate 252 from notch 244 to riser 253. Overlay 260 also includes a tongue 264 which extends along riser 253 and then freely projects above riser 253. Overlay 260 has a width substantially equal to the width of slot 230 such that overlay 260 can be received within slot 230.

Figure 19:
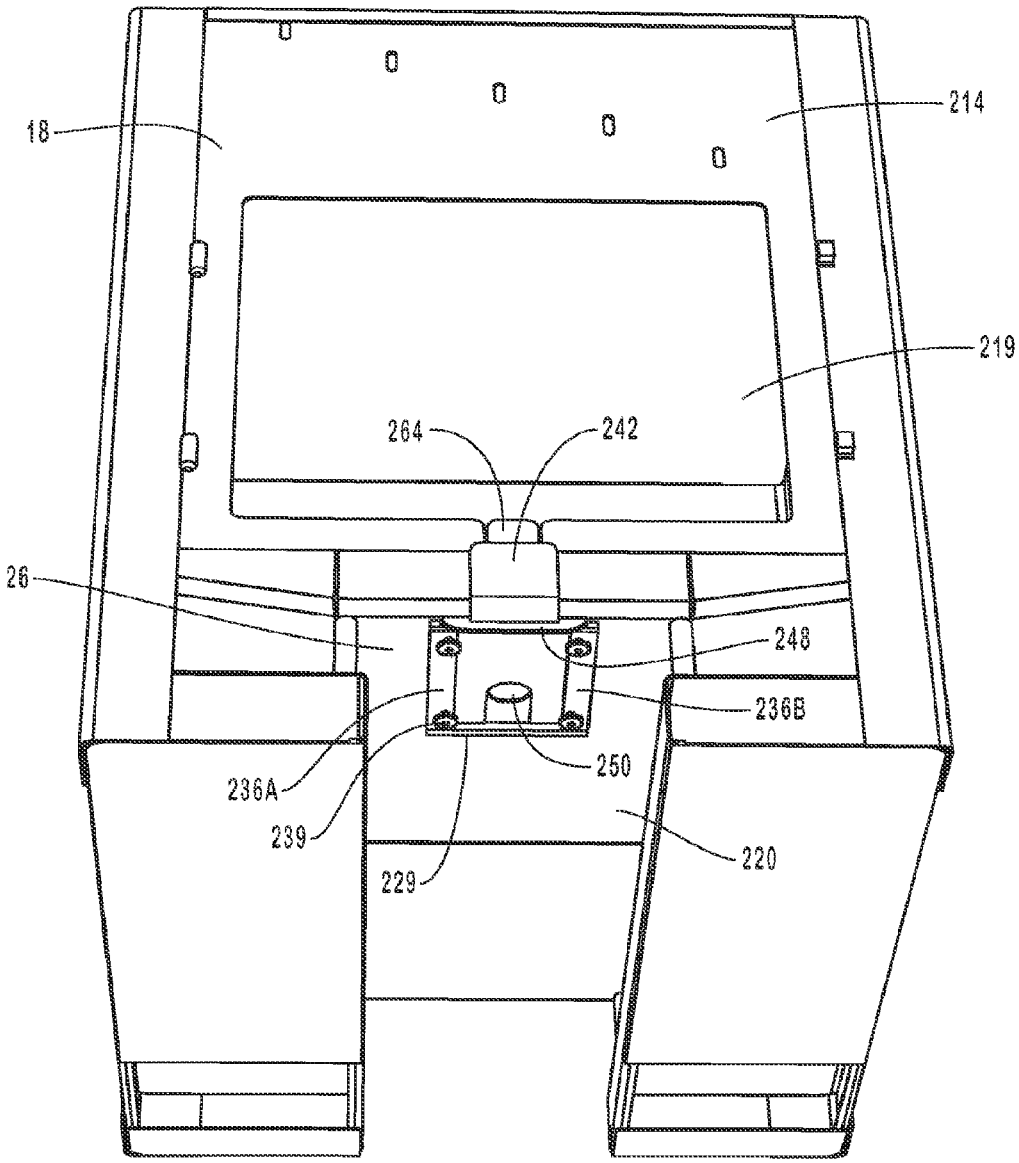
FIG. 19 is a bottom perspective view of the fluid bin assembly shown in FIG. 14 without the door.

As depicted in FIG. 19, retention plate 242 is mounted to base floor 220 by sliding side edges 246 and 247 of base plate 252 (FIG. 18) into corresponding channels 238 of brackets 236A and B (FIG. 17). Using handle 248, retention plate 242 is advanced within channels 238 until retention plate 242 contacts stop plate 229. In this position, rounded notches 228 and 244 are aligned so as to form a circular porthole 250 which extends through base floor 220. The remainder of slot 230 on floor 26 and fixed panel 214 is covered by retention plate 242. Overlay 260 is received within slot 230 so as to substantially fill in slot 230, thereby forming a smooth transition with the remainder of interior surface 30 of bin 12. It is noted that tongue 264 of retention plate 242 is disposed inside of door 216 when door 216 is closed. As a result, retention plate 242 is supported by door 216 when a load is applied against retention plate 242 from within bin 202. Finally, retention plate 242 is secured in position by manually tightening fasteners 239 so that shafts 240 bear against retention plate 242.

Figure 20:
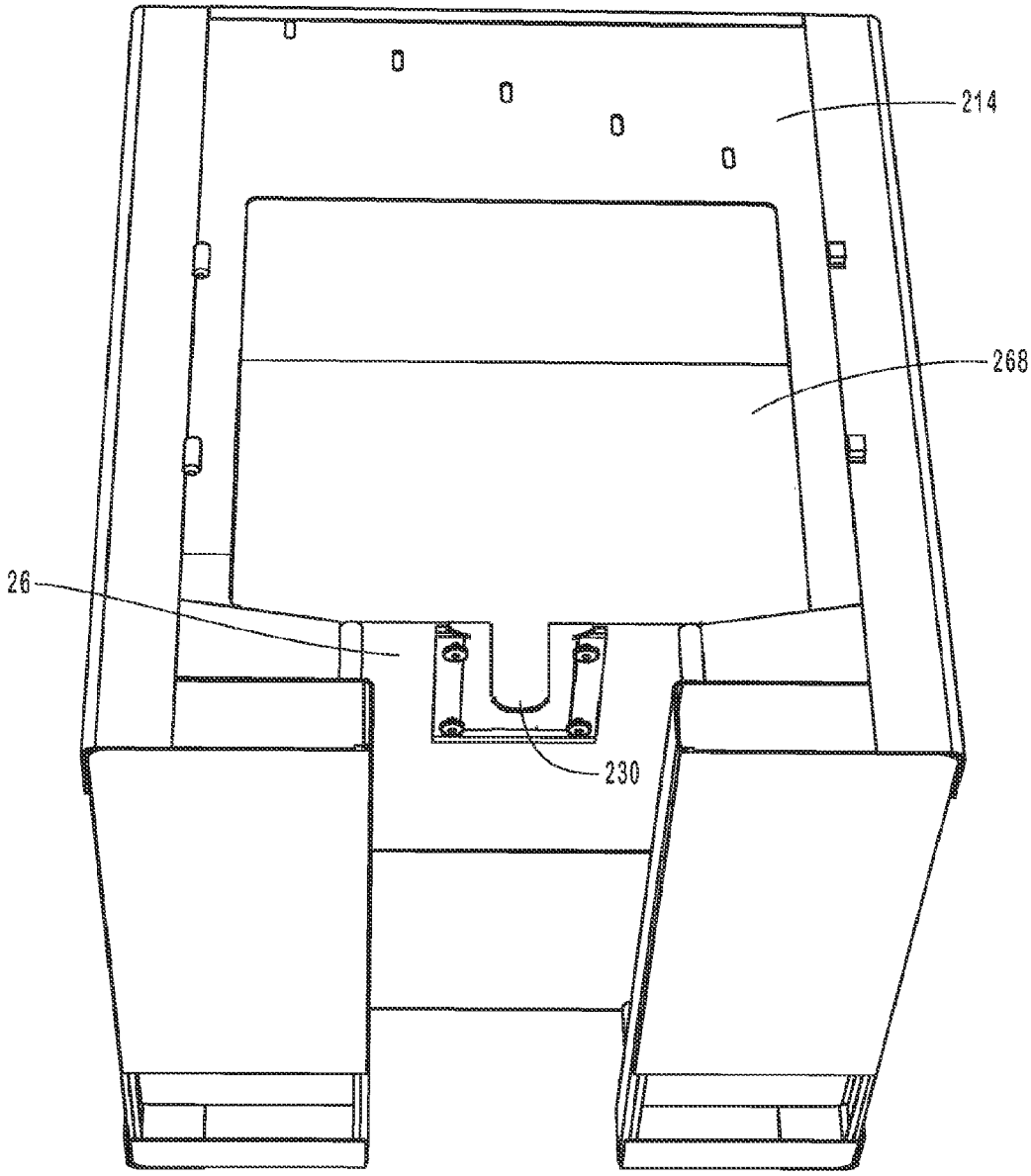
FIG. 20 is a perspective view of an alternative embodiment of the fluid bin assembly show in FIG. 14.

Depicted in FIG. 16, fixed panel 214 includes a lower portion 266 that extends between doorway 219 and floor 26. It is this lower portion 266 through which slot 230 extends. In another alternative embodiment depicted in FIG. 20, fixed panel 214 includes a doorway 268 that extends all the way to floor 26 such that the portion of slot 230 formed on floor 26 communicates directly with doorway 268. In this embodiment, either a flat retention plate can be used or an L-shaped retention plate where a portion of the L-shaped retention plate is captured between the door and the chamber 32 when the door is closed.

Figure 21:
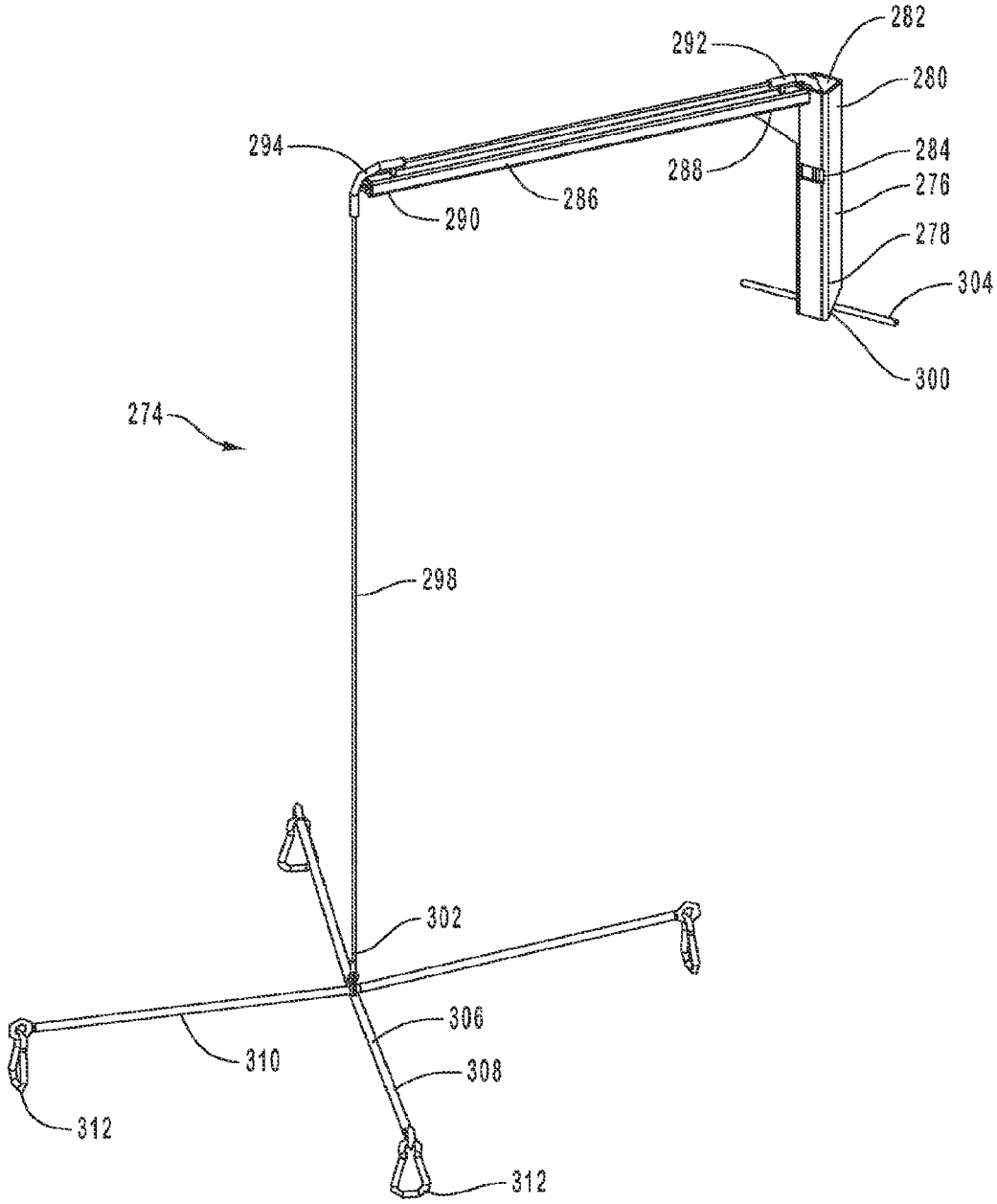
FIG. 21 is a perspective view of a bag hoist.

Depicted in FIG. 21 is one embodiment of a bag hoist 274 that can be used as an accessory with the fluid bin assemblies. Bag hoist 274 comprises an elongated tubular stand 276 having a first end 278 and an opposing second end 280 with a channel 282 extending therebetween. A slot 284 extends through the side of stand 276 at a location between the opposing ends so as to communicate with channel 282. A rigid support arm 286 outwardly projects from stand 276 such that support arm 286 forms a cantilever. Specifically, support arm 286 has a first end 288 rigidly connected to second end 280 of stand 276 and has a freely disposed second end 290.

A tubular, L-shaped first bushing 292 is mounted to stand 276 and/or support arm 286 at the intersection of these structures. First bushing 292 is positioned so as to transition from channel 282 of stand 276 to the top surface of support arm 286. A tubular, L-shaped second bushing 294 is mounted at second end 290 of support arm 286. Second bushing 294 is positioned so as to transition from the top surface of support arm 286 to a downward direction over the end of support arm 286. In one embodiment bushings 292 and 294 are comprised of a polymeric material such as nylon. Other materials can also be used.

Bag hoist 274 also comprises a flexible line 298 having a first end 300 and an opposing second end 302. In one embodiment line 298 is comprised of a wire rope coated with Teflon. In alternative embodiments line 298 can comprise wire, rope, cord, polymeric line, or the like. Line 298 is threaded up through channel 282 of stand 276 and then through first bushing 292 and second bushing 294. An elongated handle 304 is secured to first end 300 of line 298. Handle 304 has a dimension larger than channel 282 such that handle 304 prevents first end 300 of line 298 from passing through stand 276.

Mounted at first end 300 of line 298 is a hanger 306. In the embodiment depicted, hanger 306 comprises a first rod 308 and a second rod 310. Rods 308 and 310 are centrally connected to each other, such as by welding, so as to form a cross. In one embodiment, each end of each rod 308, 310 slopes or curves upwardly. Alternatively, each rod 308, 310 can be linear. Mounted on each end of rods 308, 310 is a connector 312. It is appreciated that connector 312 can comprise a snap, clip, hook, shackle, or any other structure capable of connecting to a bag or a structure on a bag such as a loop.

Figure 22:
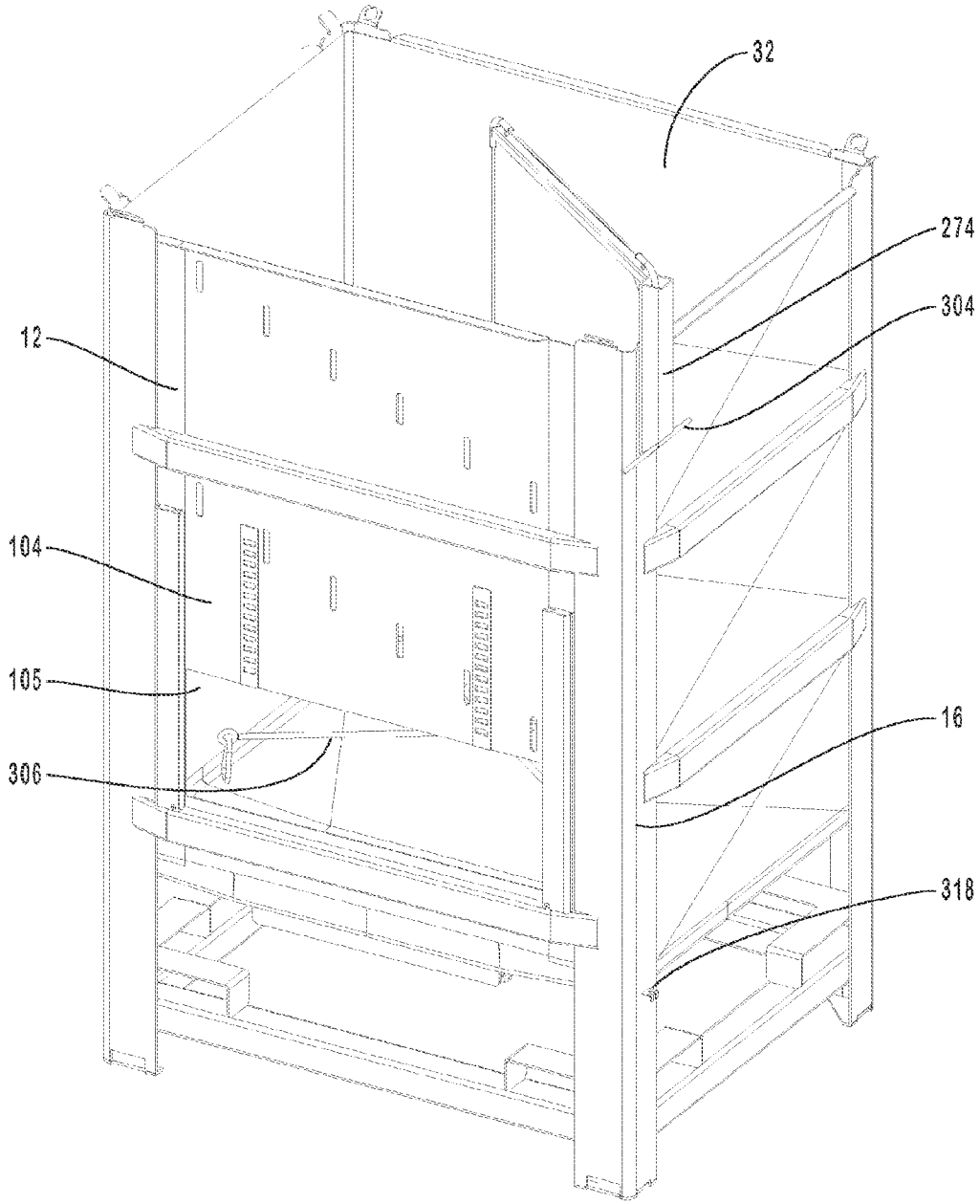
FIG. 22 is a perspective view of the bag hoist shown in FIG. 21 mounted to a fluid bin assembly.

Turning to FIG. 11, outwardly projecting from leg 16 at a distance down below a retention tab 59 is a catch 316. To mount bag hoist 274 (FIG. 21) to bin 12, retention tab 59 is slid within slot 284 of stand 276 while the first end 278 of stand 276 is slid onto catch 316. In this assembled configuration as shown in FIG. 22, hanger 306 is disposed within chamber 32 of bin 12 while support arm 286 projects above and over chamber 32. By selectively pulling down and raising up handle 304, hanger 306 selectively raises and lowers within chamber 32. Mounted at the lower end of leg 16 is a forked clasp 318. To retain hanger 306 in an elevated position, handle 304 is selectively pulled down and captured by clasp 318.

It is appreciated that bag hoist 274 can have a variety of different configurations. For example, rods 308 and 310 can be replaced with a plate or any other structure that allows connectors 312 to be positioned radially outward from line 298. Likewise, it is appreciated that any number of conventional structures and techniques can be used to secure stand 276 to bin 12.

Figure 23:
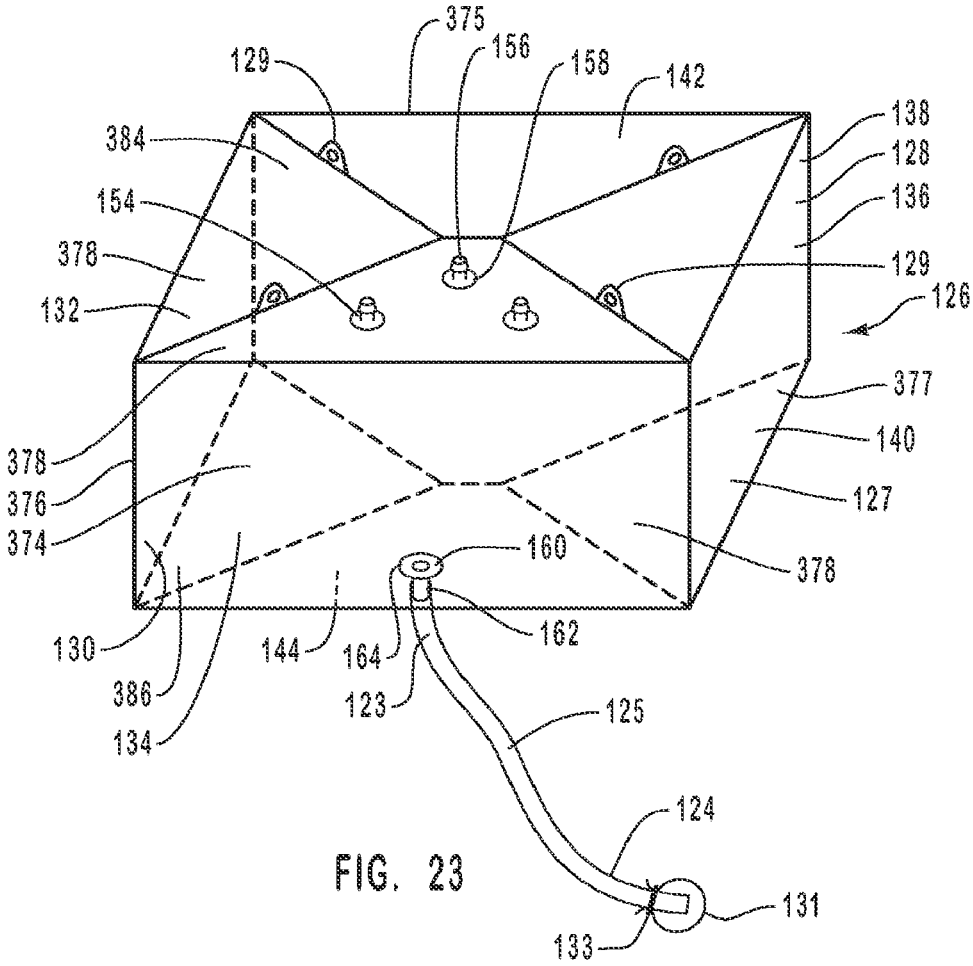
FIG. 23 is a perspective view of a fluid bag assembly.

Depicted in FIG. 23 is a perspective view of one embodiment of a bag assembly 126 that can be used in association with the bins of the present invention. Bag assembly 126 comprises a bag 127 having a fluid line 125 fluid coupled therewith. Bag 127 comprises a collapsible body 128 having one or more ports mounted thereon. In the embodiment depicted, body 128 has a substantially box shaped configuration complementary to chamber 32 of bin 12. Body 128 has an interior surface 130 and an exterior surface 132. Interior surface 130 bounds a compartment 134. Body 128 can be formed having any desired size. For example, body 128 can be formed having compartment 134 sized to hold 500 liters, 1,000 liters, 1,500 liters, or any other desired amounts.

More specifically, body 128 comprises an encircling side wall 136 that, when body 128 is unfolded, has a substantially square or rectangular transverse cross section. Side wall 136 has an upper end 138 and an opposing lower end 140. Upper end 138 terminates at a two-dimensional top end wall 142 while lower end 140 terminates at a two-dimensional bottom end wall 144. A plurality of spaced apart hanger mounts 129 are mounted on top end wall 142. Hanger mounts 129 can comprise a tab having a hole extending therethrough, a loop, or any other structure that can be engaged by connectors 312 of bag hoist 274.

Body 128 is comprised of a flexible, water impermeable material such as low-density polyethylene or other polymeric sheets having a thickness in a range between about 0.1 mm to about 5 mm with about 0.2 mm to about 2 mm being more common. Other thicknesses can also be used. The material can be comprised of a single ply material or can comprise two or more layers which are either sealed together or separated to form a double wall container. Where the layers are sealed together, the material can comprise a laminated or extruded material. The laminated material comprises two or more separately formed layers that are subsequently secured together by an adhesive.

The extruded material comprises a single integral sheet which comprises two or more layers of different material that are each separated by a contact layer. All of the layers are simultaneously co-extruded. One example of an extruded material that can be used in the present invention is the HyQ CX3-9 film available from HyClone Laboratories, Inc. out of Logan, Utah. The HyQ CX3-9 film is a three-layer, 9 mil cast film produced in a cGMP facility. The outer layer is a polyester elastomer coextruded with an ultra-low density polyethylene product contact layer. Another example of an extruded material that can be used in the present invention is the HyQ CX5-14 cast film also available from HyClone Laboratories, Inc. The HyQ CX5-14 cast film comprises a polyester elastomer outer layer, an ultra-low density polyethylene contact layer, and an EVOH barrier layer disposed therebetween.

Still another example of a film that can be used is the Attane film which is likewise available from HyClone Laboratories, Inc. The Attane film is produced from three independent webs of blown film. The two inner webs are each a 4 mil monolayer polyethylene film (which is referred to by HyClone as the HyQ BM1 film) while the outer barrier web is a 5.5 mil thick 6-layer coextrusion film (which is referred to by HyClone as the HyQ BX6 film). In yet other embodiments, body 128 can be made exclusively of the HyQ BM1 film or the HyQ BX6 film.

In one embodiment, the material is approved for direct contact with living cells and is capable of maintaining a fluid sterile. In such an embodiment, the material should also be sterilizable such as by ionizing radiation. Other examples of materials that can be used are disclosed in U.S. Pat. No. 6,083,587 which issued on Jul. 4, 2000 and U.S. patent application Ser. No. 10/044,636, filed Oct. 9, 2001 which are hereby incorporated by specific reference.

Figure 24:
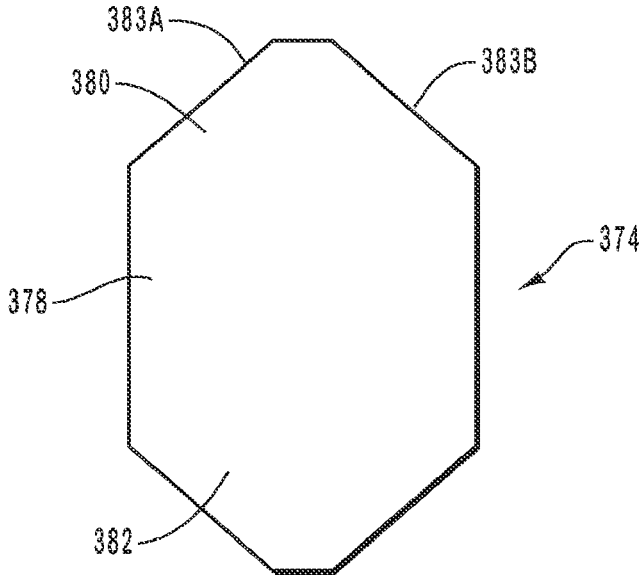
FIG. 24 is an elevated side view of a panel of the bag shown in FIG. 23.

Three dimensional body 128 is comprised of four discrete panels, i.e., a front panel 374, a back panel 375, a first side panel 376, and a second side panel 377. Each panel 374-377 has a substantially square or rectangular central portion 378. As depicted in FIG. 24, front panel 374 has a first end portion 380 and a second end portion 382 projecting from opposing ends of central portion 378. Each of end portions 380 and 382 has a trapezoidal configuration with opposing tapered sides 383A and B. Back panel 375 is substantially identical to front panel 374. Returning to FIG. 23, each of side panels 376 and 377 has a triangular first end portion 384 and an opposing triangular second end portion 386 at the opposing ends of central portion 378. Corresponding perimeter edges of each panel 374-377 are seamed together so as to form body 128 having a substantially box shaped configuration. Hanger mounts 129 are attached to body 128 by being secured within the seams. In this assembled configuration, each of panels 374-377 is folded along the intersection of the central portion and each of the end portions such that the end portions combine to form top end wall 142 and bottom end wall 144.

Panels 374-377 are seamed together using methods known in the art such as heat energies, RF energies, sonics, other sealing energies, adhesives, or other conventional processes. It is appreciated that by altering the size and configuration of some or all of panels 374-377, body 128 can be formed having a variety of different sizes and configurations. For example, side wall 136 can have a transverse cross section that is circular, polygonal, elliptical, or other configurations. The size and configuration of body 128 can also be altered by varying the number of panels used to make body 128. Although body 128 is shown having a substantially box shaped configuration, body 128 conforms to the configuration of chamber 32 of bin 12 as body 128 is filled with fluid. Thus body 128 can be complementary to or different from the configuration of chamber 32 of bin 12. When body 128 is received within chamber 32, however, it is desirable that body 128 be uniformly supported by bin 12. This substantially uniform support of body 128 by bin 12 helps to preclude failure of body 128 by hydraulic forces applied to body 128 when filled with a fluid.

In alternative methods of production, it is appreciated that three-dimensional body 128 can be formed by initially extruding or otherwise forming a polymeric sheet in the form of a continuous tube. Each end of the tube can then be folded like the end of a paper bag and then seamed closed so as to form a three dimensional body. In still another embodiment, a length of tube can be laid flat so as to form two opposing folded edges. The two folded edges are then inverted inward so as to form a pleat on each side. The opposing ends of the tube are then seamed closed. Finally, an angled seam is formed across each corner so as to form a three dimensional bag when unfolded.

In contrast to being three-dimensional, body 128 can also comprise a two-dimensional pillow style bag. In one method of forming a two-dimensional pillow style bag, two sheets of material are placed in overlapping relation and the two sheets are bounded together at their peripheries to form internal compartment 134. Alternatively, a single sheet of material can be folded over and seamed around the periphery to form internal compartment 134. In another embodiment, body 128 can be formed from a continuous tubular extrusion of polymeric material that is cut to length and each end seamed closed.

It is appreciated that the above techniques can be mixed and matched with one or more polymeric sheets and that there are still a variety of other ways in which body 128 can be formed having a two or three dimensional configuration. Further disclosure with regard to one method of manufacturing three-dimensional bags is disclosed in U.S. patent application Ser. No. 09/813,351, filed on Mar. 19, 2001 of which the drawings and Detailed Description are hereby incorporated by specific reference.

Mounted on top end wall 142 of body 128 are a plurality of spaced apart ports 154. Each port 154 comprises a barbed tubular stem 156 having a flange 158 outwardly projecting from an end thereof. Flange 158 is secured to body 128 using conventional welding or sealing techniques. During use, each port 154 is either sealed closed, such as by a cap, or is fluid coupled with a tube, container, or other structure for delivering material into and/or out of compartment 134. It is appreciated that any number of ports 154 can be formed on body 128 and that a variety of different types and sizes of ports can be used depending on the type of material to be dispensed into compartment 134 and how the material is to be dispensed therein. For example, rather than having barbs formed thereon, ports 154 can be formed with quick connects or lure fittings. In still other embodiments, it is appreciated that ports 154 can be eliminated.

Mounted on bottom end wall 144 of body 128 is another port 160 having a barbed tubular stem 162 with a flange 164 outwardly projecting from an end thereof. Fluid line 125 has a first end 123 and an opposing second end 124. First end 123 is fluid coupled with port 160. The terminus at second end 124 is sealed within a polymeric bag 131 which is held on by a tie 133. Similar types of fluid lines can also be mounted to each of ports 154. In one alternative, fluid line 125 can be integrally formed with port 160. Likewise, port 160 can have a variety of different configurations as discussed above.

The bag assemblies and bins of the present invention can be used for holding, moving, processing and/or dispensing any type of fluid for any application. It is appreciated, however, that the bag assemblies and bins are uniquely designed for operating filtered and/or sterile fluids. For example, bag assembly 126 can be used to hold culture media, serum, buffers, reagents, vaccines, cell cultures, process liquids, or other biologicals. Where a filtered and/or sterile fluid is to be held and dispensed from bag assembly 126, bag assembly 126 is formed with each port 154 either sealed closed with a cap or having a fluid line coupled therewith the distal terminus of the line being sealed closed such as by bag 131. Bag 127 is typically formed in a folded or collapsed configuration so that substantially all of the air is removed therefrom. Closing the ports results in chamber 134 being sealed closed. The entire bag assembly 126 is then sterilized as a unit such as by gamma radiation or other conventional techniques.

With regard to bin 12 in FIG. 1, during use the empty bag assembly 126 is positioned within the chamber 32. This can be accomplished by opening door 108 and passing bag assembly 126 through doorway 105. Alternatively, bag assembly 126 can be positioned within chamber 32 through top opening 36.

Porthole 96 formed by retention plates 80 and 82 (FIG. 5) is positioned to receive port 160. For example, in one embodiment porthole 96 is larger than stem 162 of port 160 having fluid line 125 disposed thereover. In this embodiment, bag assembly 126 can be inserted within chamber 32 of bin 12 either before or after retention plates 80 and 82 are mounted to floor 26. By raising door 108, doorway 105 can be used to properly orientate bag assembly 126 within chamber 32. Second end 124 of fluid line 125 is then passed down through porthole 96 until port 160 is received within porthole 160. Where non-filtered or non-sterile fluids are being held and dispensed from bag 127, bag 127 can initially be positioned within chamber 32 without fluid line 125 coupled therewith. Once port 160 is received within porthole 96, fluid line 125 can then be coupled with port 160 from outside of bin 12. It is noted that in smaller bins 12, door 108 can be eliminated because porthole 96 can be accessed through top opening 36 to chamber 34.

Once bag assembly 126 is properly positioned within bin 12, ports 154, 160 or the fluid lines extending therefrom can be coupled with tubes, containers, filters and/or other structures for delivering fluid into and out of compartment 134 of bag 127. For example, to maintain the terminal end of fluid line 125 sterile, second end 124 can be passed into a laminar air flow hood having a clean environment. Within the hood, a sterile connection can be made between second end 124 of fluid line 125 and other desired structure. In other embodiments, a sterile connection can be made to line 125 using conventional sterilization techniques such as steam, vapor, chemicals or localized radiation. It is noted that port 160 is typically used for removal of fluid since it can operate under a gravity feed. However, port 160 can be used to deliver fluid into bag 127 or, during a single use, can be used to both deliver fluid into and out of bag 127.

Figure 25:
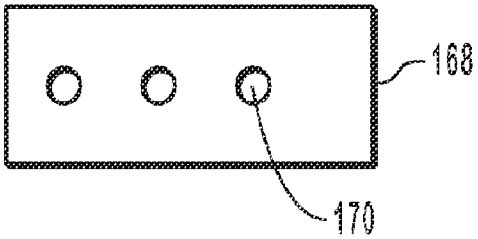
FIGS. 25-27 are alternative embodiments of the retention plates shown in FIG. 6.

Depending on the manufacturer and the intended use for bag assembly 126, any number of ports 160 having different sizes, configurations, and placement patterns can be formed on bottom end wall 144 of body 128. To accommodate for different sizes, configurations, and placement patterns for different ports, a variety of different retention plates are provided having or combining to form corresponding portholes. For example, depicted in FIG. 25 is one embodiment of a single, solid retention plate 168 having a plurality of spaced apart portholes 170 extending therethrough. Retention plate 168 can thus be mounted on floor 26 of bin 12 so that each porthole 170 can receive a port and/or fluid line coupled with and extending from a bag.

Figure 26:
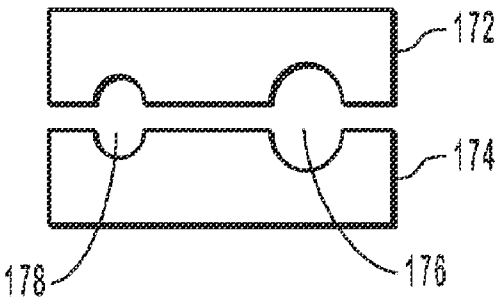
Figure 27:
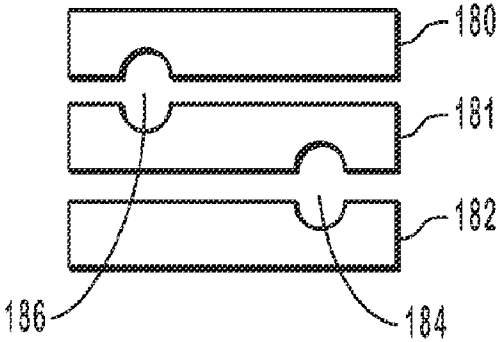

Depicted in FIG. 26 are two retention plates 172 and 174. Each plate 172 and 174 has complementary grooves so that laterally spaced apart portholes 176 and 178 of different size are formed when plates 172 and 174 are positioned within channel 66 of floor 26. Portholes 176 and 178 are thus adapted to receive a port and/or fluid line of different size or shape. Finally, depicted in FIG. 27 are three retention plates 180-182. Each of retention plates 180-182 has complementary grooves so that portholes 184 and 186 that are spaced apart both laterally and front-to-back are formed when plates 180-182 are positioned within channel 66 of floor 26.

Accordingly, by using desired configurations and combinations of retention plates, bin 12 can be adapted to fit bag assemblies having ports of any size, configuration and/or pattern. This is a substantial benefit over conventional fluid dispensing bins which have a fixed floor and fixed porthole configuration. That is, unlike conventional fluid dispensing bins where an owner is limited to using one type of bag, the bins of the present invention can be used in association with a variety of different bags made from different manufacturers. Furthermore, because of the adaptability of the inventive bins, manufacturers are free to make modifications to their bags and to make customized bags for unique applications.

In contrast to simply receiving a port within a porthole, the retention plates can also be used to securely hold ports and/or fluid tubes therein. For example, with reference to FIGS. 5-7, either before or after insertion of bag assembly 126 within chamber 32 of bin 12, first retention plate 80 is secured within channel 66. Port 160 is then received within groove 88 of first retention plate 80. Next, second retention plate 82 is slid within channel 66. Grooves 88 and 94 are sized or configured to squeeze or otherwise securely engage port 160 therebetween when plates 80 and 82 are mated or pushed toward each other. Fasteners 70 are then tightened so as to secure plates 80 and 82 in place. As a result, port 160 is securely held in place by retention plates 80 and 82.

To further secure the engagement with retention plates 80 and 82, it is envisioned that port 160 can be formed with an outwardly projecting flange that is disposed below the bottom surface of retention plates 80, 82. The flange has a diameter larger than porthole 96 so as to prevent port 160 from pulling up through porthole 96 until retention plates 80 and 82 are separated. In the above embodiment, it is appreciated that port 160 would have an extended length so that the fluid line could couple with the portion of port 160 extending below retention plates 80 and 82. In an alternative embodiment, it is also appreciated that grooves 88 and 94 can be sized or configured to squeeze or otherwise securely engage fluid line 125 encircling port 160 when plates 80 and 82 are mated or pushed toward each other. An outwardly projecting flange can also be formed on fluid line 125.

In yet other embodiments, it is appreciated that a variety of different structures can be mounted on the second end of fluid line 125. Examples of such structures include filling bells, filters, other bag or containers, extended lengths of fluid line, and the like. By initially forming a bag assembly with such structures attached thereto, the entire system can be easily sterilized by such processes as gamma radiation. Such structures, however, are too large to fit through the portholes of conventional fluid bins. In the present embodiment, however, the structure can be passed through the large opening 46 on floor 26 of bin 12 prior to inserting the second retention plate 82.

Bin assembly 200 as depicted in FIGS. 14-19 has the additional benefit of not requiring second end 124 of fluid line 125, or any structure mounted thereon, to pass through a closed opening. That is, during use door 216 of bin 202 is opened and bag 127 is positioned within chamber 32 thereof. Second end 124 of fluid line 125 can be positioned within chamber 32 and then advanced through slot 230. Alternatively, however, fluid line 125 can extend out of doorway 219 so that second end 124 of fluid line 125 remains perpetually outside of chamber 32. A section of fluid line 125 between second end 124 and first end 123 can then be slid from doorway 219 directly into slot 230. Port 160 is then positioned within notch 228 on floor 26. Retention plate 242 is then mounted on floor 26 as discussed above so that slot 230 is substantially closed by retention plate 242 except for porthole 250 through which port 160 and fluid line 125 extend. Bag 127 is thus supported on floor 26 and retention plate 242. Alternatively, fluid line 125 can be disposed within slot 230 while retention plate 242 is mounted. Port 160 can then be positioned within porthole 250.

Independent of the fluid bin assembly used, once bag assembly 126 is positioned and the retention plate(s) secured, the door can be closed and locked. Bag 127 can then be filled with fluid through one or more of ports 154 and 160. As bag 127 fills with fluid, bag 127 expands within chamber 32. In some embodiments, especially where the bag is very large, the fluid can bear against folds in bag 127 making it difficult for bag 127 to properly expand without failure of the bag. To enable proper expansion of bag 127, bag 127 can be monitored and manually manipulated as it is filled so as to remove the folds. Alternatively, bag 127 can be secured to hoist 274.

To facilitate use of bag hoist 274, bag hoist 274 is mounted to the bin as previously discussed. Hanger 306 is then lowered into chamber 32. Either before or after positioning port 160 into the porthole, connectors 312 on hanger 306 are attached to corresponding hanger mounts 129 on bag 127. The radial dimension of hanger 306 helps to unfold bag 127 laterally. Next, handle 304 is lowered and connected to clasp 318. In so doing, bag 127 is vertically raised or expanded within chamber 32. Port 160, however, is retained within the porthole. In this raised position, the lower end of bag 127 can be manually unfolded and positioned. In this position, fluid is delivered into bag 127 through one of the ports. Because of the vertical and horizontal displacement of bag 127 by bag hoist 274, bag 127 is substantially free to expand within chamber 32 without undesired kinking or folding. Once bag 127 is filled with fluid, handle 304 is disconnected from clasp 318. Bag 127 is thus free to collapse as the fluid is removed from bag 127. Bag hoist 274 can be disconnected from bag 127 either prior to, during, or after dispensing of the fluid from bag 127.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for filling a dispensing bag, the method comprising:

inserting a collapsed bag within a chamber of a bin, the bag having a sterilized compartment that is sealed closed;

securing a lower end of the collapsed bag to the bin after inserting the collapsed bag within the chamber of the bin;

securing a hoist to hanger mounts on the collapsed bag; and after securing the lower end of the collapsed bag to the bin and securing the hoist to the hanger mounts, manipulating the hoist secured to the collapsed bag so that the hoist raises an upper end of the collapsed bag within the chamber while the lower end of the collapsed bag remains secured to the bin so as to expand the collapsed bag within the chamber of the bin.

2. The method as recited in claim 1, wherein the step of securing the lower end of the collapsed bag comprises securing the lower end of the collapsed bag to a floor of the bin.

3. The method as recited in claim 1, wherein the step of securing the lower end of the collapsed bag comprises securely fixing a first port projecting from the lower end of the collapsed bag within a port hole formed on the floor of the bin.

4. The method as recited in claim 3, wherein the first port is securely fixed by frictional engagement to a retention plate disposed on a floor of the bin.

5. The method as recited in claim 1, wherein the step of inserting the collapsed bag comprises:

placing the collapsed bag within the chamber of the bin, the bin having an opening extending through a floor of the bin;

either before or after placing the collapsed bag within the chamber, positioning a first retention plate so that the first retention plate at least partially covers the opening extending through the floor, the first retention plate at least partially bounding a port hole; and advancing a first port projecting from the lower end of the collapsed bag into the port hole.

6. The method as recited in claim 5, wherein the step of securing the lower end of the collapsed bag to the bin comprises fixing the first retention plate to the bin so that the first port is pressed against the first retention plate and thereby securely holds to the first port.

7. The method as recited in claim 5, wherein the step of securing the lower end of the collapsed bag to the bin comprises compressing the first port between the first retention plate and the floor of the bin.

8. The method as recited in claim 5, wherein the step of securing the lower end of the collapsed bag to the bin comprises compressing the first port between the first retention plate and a second retention plate disposed on the floor of the bin.

9. The method as recited in claim 1, wherein the step of securing the lower end of the collapsed bag comprises securely fixing an elongated tube projecting from the lower end of the collapsed bag within a port hole formed on the floor of the bin.

10. The method as recited in claim 1, wherein the step of inserting the collapsed bag comprises:

placing the collapsed bag within the chamber of the bin, the bin having an opening extending through a floor of the bin;

either before or after placing the collapsed bag within the chamber, positioning a first retention plate so that the first retention plate at least partially covers the opening extending through the floor, the first retention plate at least partially bounding a port hole; and advancing an elongated tube projecting from the lower end of the collapsed bag into the port hole.

11. The method as recited in claim 10, wherein the step of securing the lower end of the collapsed bag to the bin comprises fixing the first retention plate to the bin so that the elongated tube is pressed against the first retention plate and thereby securely holds to the retention plate.

12. The method as recited in claim 10, wherein the step of securing the lower end of the collapsed bag to the bin comprises compressing the elongated tube between the first retention plate and the floor of the bin or between the first retention plate and a second retention plate disposed on the floor of the bin.

13. The method as recited in claim 1, further comprising:

delivering a fluid into the bag after the bag has been expanded; and dispensing the fluid from the bag.

14. The method as recited in claim 13, further comprising separating the hoist from the bag before dispensing the fluid from the bag.

15. The method as recited in claim 1, wherein the hoist comprises:

a stand removably mounted to the bin, a support arm projecting from the stand so as to extend over the chamber of the bin; and an elongated line slidably mounted on the support arm, the line having a first end and an opposing second end, the line being selectively movable on the support arm such that the second end can be selectively raised and lowered within the chamber of the bin, the second end of the line being coupled to the bag, and wherein manipulating the hoist comprises raising the second end of the line.

16. The method as recited in claim 15, wherein a hanger is mounted on the first end of the line; and a plurality of connectors are mounted to the hanger, each connector engaging a corresponding hanger mount, and wherein raising the first end of the line causes the hanger to be raised.

17. The method as recited in claim 1, wherein the hoist comprises a hanger mounted on an end of the elongated line and a plurality of connectors mounted to the hanger, each connector engaging a corresponding hanger mount secured on the bag, and wherein selectively moving the elongated line causes the hanger to move the hanger mounts so as to raise the upper end of the collapsed bag.

18. The method as recited in claim 1, wherein the step of manipulating the hoist comprises the hoist being a mechanical hoist.

19. The method as recited in claim 1, wherein the step of manipulating the hoist comprises the hoist being secured to the bin.

20. The method as recited in claim 1, further comprising delivering fluid into the expanded bag while the bag is supported by the hoist.

21. The method as recited in claim 20, wherein the fluid comprises a culture media, serum, buffer, reagent, vaccine, or cell culture.

22. A method for filling a dispensing bag, the method comprising:

inserting a collapsed bag within a chamber of a bin, the bag having a sterilized compartment that is sealed closed;

securing a lower end of the collapsed bag to the bin after inserting the collapsed bag within the chamber of the bin; and after securing the lower end of the collapsed bag to the bin, manipulating a hoist secured to the bin and coupled to an upper end of the collapsed bag so that the hoist raises the upper end of the collapsed bag within the chamber while the lower end of the collapsed bag remains secured to the bin so as to expand the collapsed bag within the chamber of the bin.

23. The method as recited in claim 22, wherein the step of securing the lower end of the collapsed bag comprises securely fixing a first port projecting from the lower end of the collapsed bag within a port hole formed on the floor of the bin.

24. The method as recited in claim 23, wherein the first port is securely fixed by frictional engagement to a retention plate disposed on a floor of the bin.

25. The method as recited in claim 22, wherein the step of inserting the collapsed bag comprises:

placing the collapsed bag within the chamber of the bin, the bin having an opening extending through a floor of the bin;

either before or after placing the collapsed bag within the chamber, positioning a first retention plate so that the first retention plate at least partially covers the opening extending through the floor, the first retention plate at least partially bounding a port hole; and advancing a first port projecting from the lower end of the collapsed bag into the port hole.

26. The method as recited in claim 22, further comprising delivering fluid into the expanded bag while the bag is supported by the hoist.

27. The method as recited in claim 26, wherein the fluid comprises a culture media, serum, buffer, reagent, vaccine, or cell culture.

28. A method for filling a dispensing bag, the method comprising:

inserting a collapsed bag within a chamber of a bin, the bag having a sterilized compartment that is sealed closed;

securing a lower end of the collapsed bag to the bin after inserting the collapsed bag within the chamber of the bin; and after securing the lower end of the collapsed bag to the bin, manipulating a hoist coupled to an upper end of the collapsed bag so that the hoist raises the upper end of the collapsed bag within the chamber while the lower end of the collapsed bag remains secured to the bin so as to expand the collapsed bag within the chamber of the bin, the hoist comprising a hanger mounted on an end of the elongated line and a plurality of connectors mounted to the hanger, each connector engaging a corresponding hanger mount secured on the bag, and wherein selectively moving the elongated line causes the hanger to move the hanger mounts so as to raise the upper end of the collapsed bag.

* * * * *